US011148873B2

(12) United States Patent
Machida et al.

(10) Patent No.: US 11,148,873 B2
(45) Date of Patent: Oct. 19, 2021

(54) ROLLER CASE

(71) Applicant: AION CO., LTD., Osaka (JP)

(72) Inventors: Chizuru Machida, Koga (JP); Shota Kazama, Koga (JP); Tadashi Kawaguchi, Koga (JP)

(73) Assignee: AION CO., LTD., Osaka (JP)

( * ) Notice: Subject to any disclaimer, the term of this patent is extended or adjusted under 35 U.S.C. 154(b) by 15 days.

(21) Appl. No.: 16/603,091

(22) PCT Filed: Apr. 5, 2018

(86) PCT No.: PCT/JP2018/014537
§ 371 (c)(1),
(2) Date: Oct. 4, 2019

(87) PCT Pub. No.: WO2018/186464
PCT Pub. Date: Oct. 11, 2018

(65) Prior Publication Data

US 2020/0071063 A1 Mar. 5, 2020

(30) Foreign Application Priority Data

Apr. 6, 2017 (JP) ..... JP2017-076218

(51) Int. Cl.
*B65D 85/08* (2006.01)
*B65D 25/10* (2006.01)
*B65D 77/20* (2006.01)

(52) U.S. Cl.
CPC ..... *B65D 85/08* (2013.01); *B65D 25/107* (2013.01); *B65D 77/20* (2013.01)

(58) Field of Classification Search
CPC ..... B65D 25/10; B65D 25/107; B65D 77/20; B65D 85/08; B65D 85/68
(Continued)

(56) References Cited

U.S. PATENT DOCUMENTS 4,079,835 A 3/1978 Kendig
7,168,654 B2 * 1/2007 Silverbrook ..... B41J 3/407 220/4.23
2015/0251834 A1 9/2015 Doering et al.

FOREIGN PATENT DOCUMENTS

JP 51-132376 A 10/1976
JP 60-112485 U 7/1985
(Continued)

OTHER PUBLICATIONS

International Search Report for PCT/JP2018/014537, dated May 29, 2018.

*Primary Examiner* — Bryon P Gehman
(74) *Attorney, Agent, or Firm* — Sughrue Mion, PLLC; Richard C. Turner

(57) ABSTRACT

A roller case (10) includes a first case body (11) and a second case body (12). In a roller-stored state, the case-closed state is kept by the engagement between the first case body (11) and the second case body (12), the roller main body (2) of the roller (1) is contained in the roller-main-body containing space (46), being spaced from the first case body (11) and the second case body (12), the one end and the other end of the rotation shaft (3) of the roller (1) are clamped in the axis crossing direction and held between the first support portions (25) of the first case body (11) and the second support portions (42) of the second case body (12), and the entire roller (1) is covered with the first case body (11) and the second case body (12).

5 Claims, 14 Drawing Sheets

(58) Field of Classification Search
USPC ..... 206/361, 446; 220/4.21–4.24
See application file for complete search history.

(56) References Cited

FOREIGN PATENT DOCUMENTS

| | | | |
|---|---|---|---|
| JP | 2-97236 | U | 8/1990 |
| JP | 2001-199639 | A | 7/2001 |
| JP | 2004-026258 | A | 1/2004 |
| JP | 2004-325690 | A | 11/2004 |
| JP | 2010-231165 | A | 10/2010 |
| JP | 2011-016594 | A | 1/2011 |
| JP | 2013-100133 | A | 5/2013 |
| JP | 2015-532246 | A | 11/2015 |

* cited by examiner

[Fig. 1]
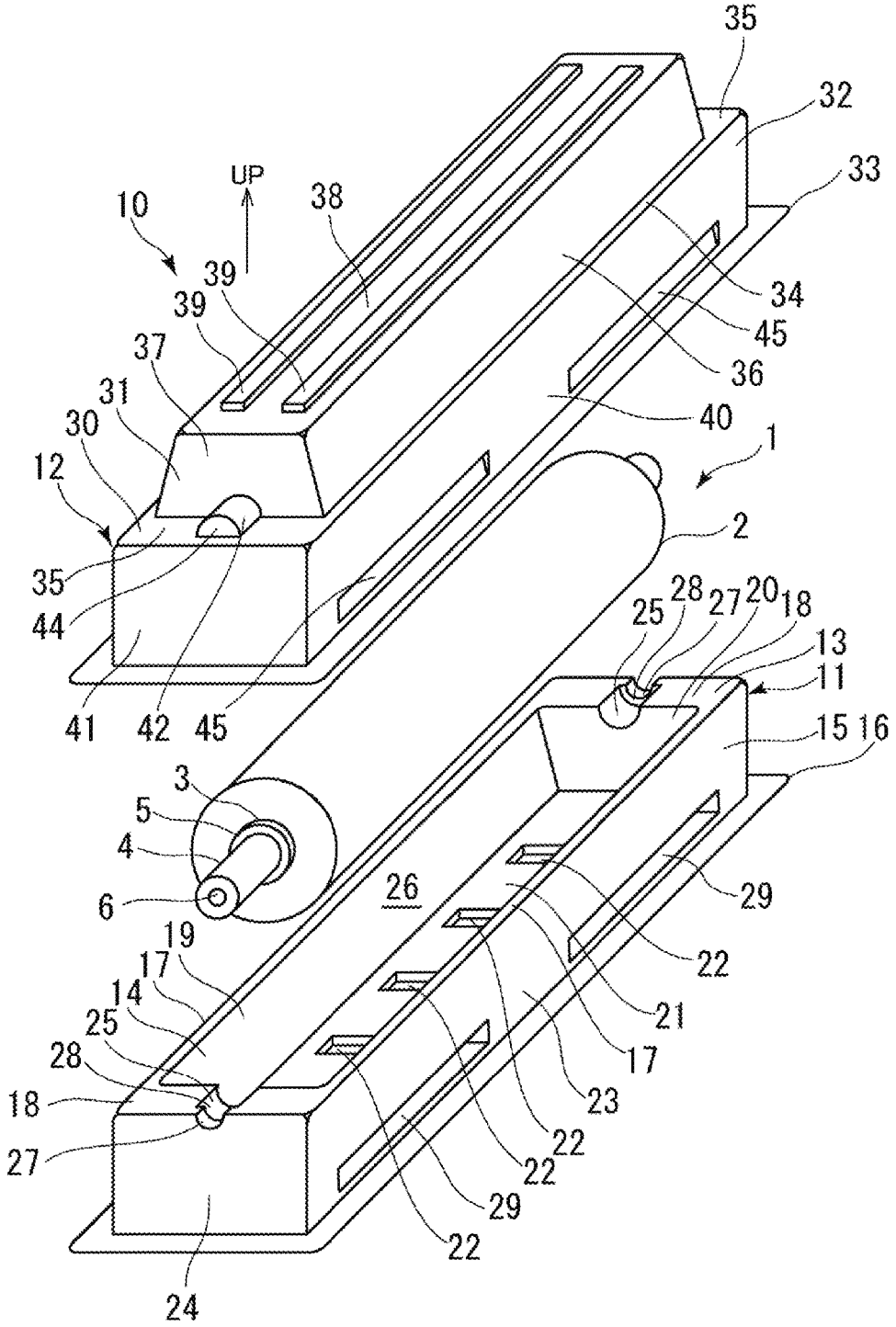

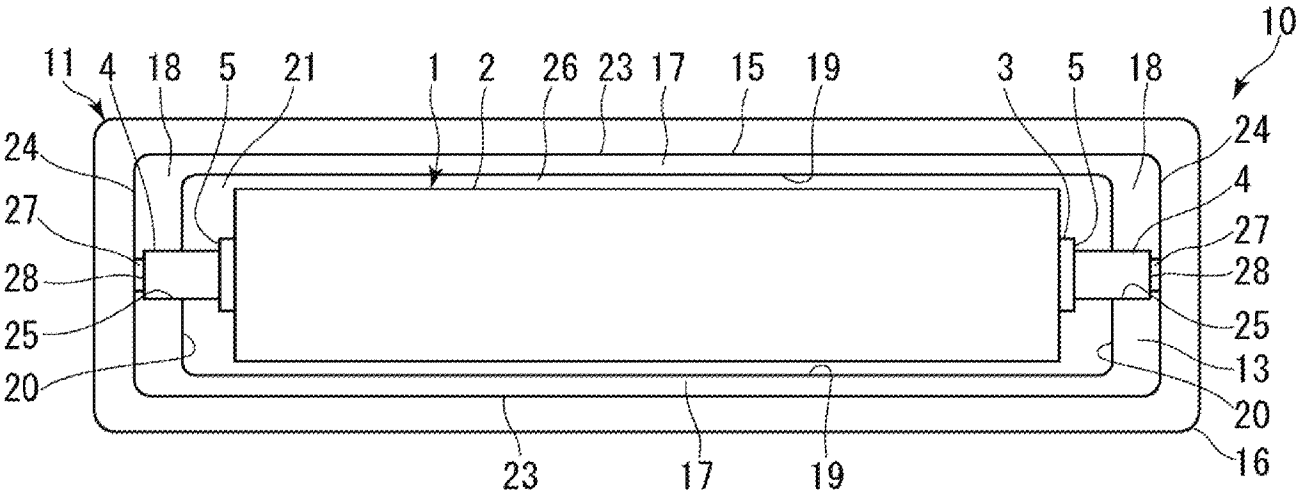
[Fig. 2(a)]
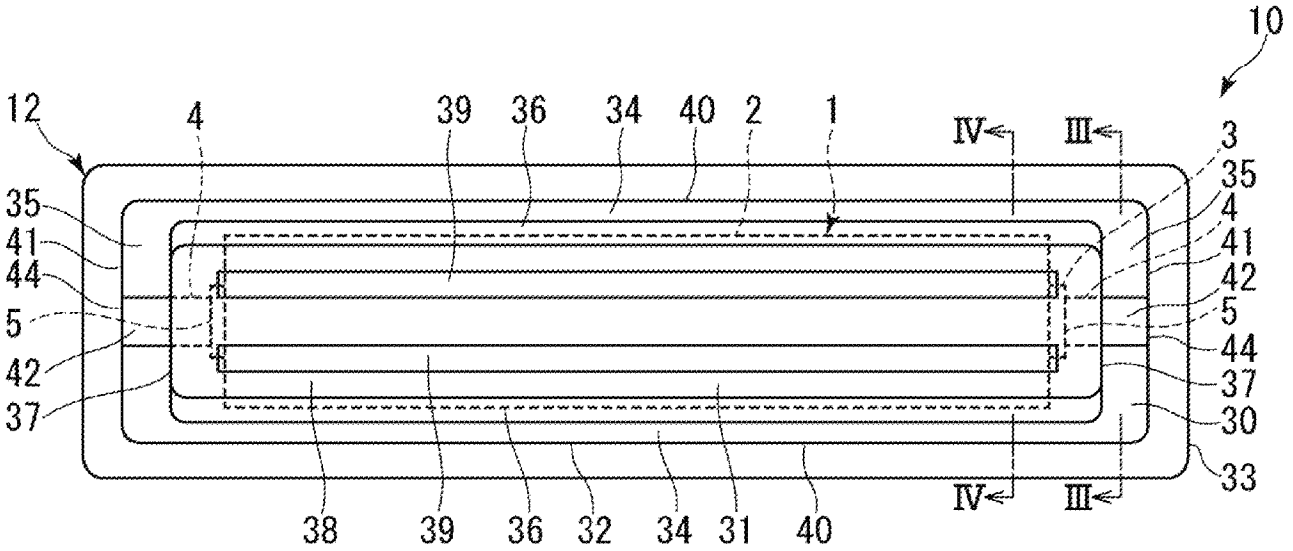
[Fig. 2(b)]

[Fig. 3]
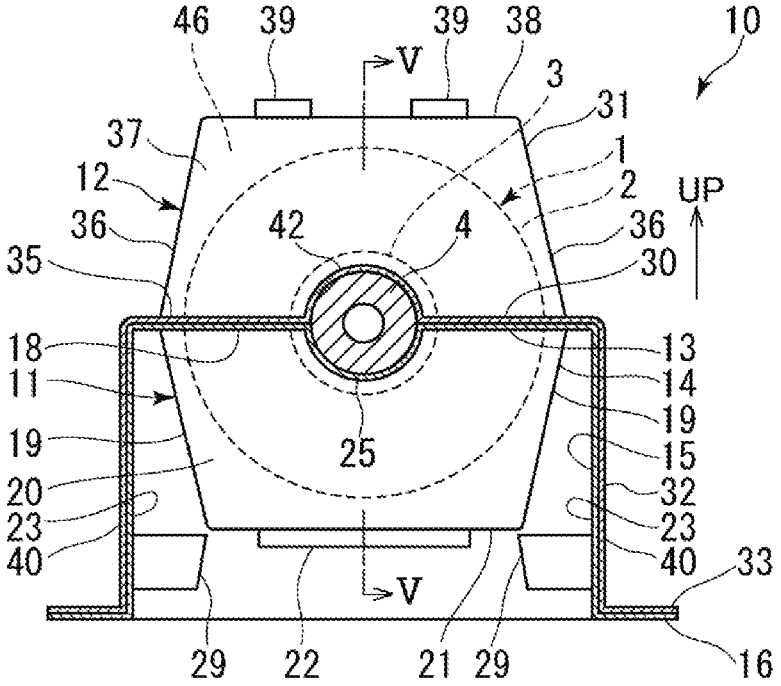
[Fig. 4]
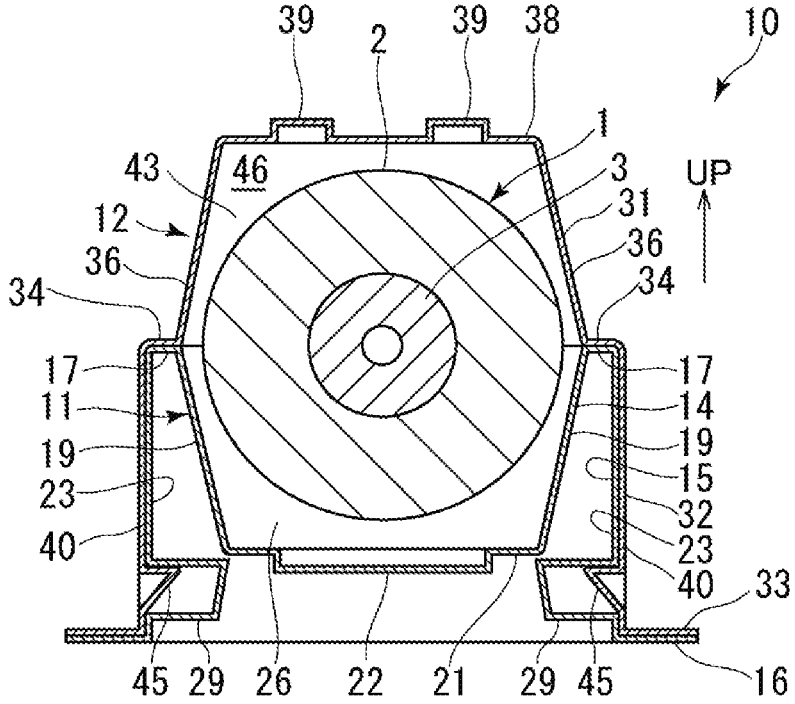

[Fig. 5]
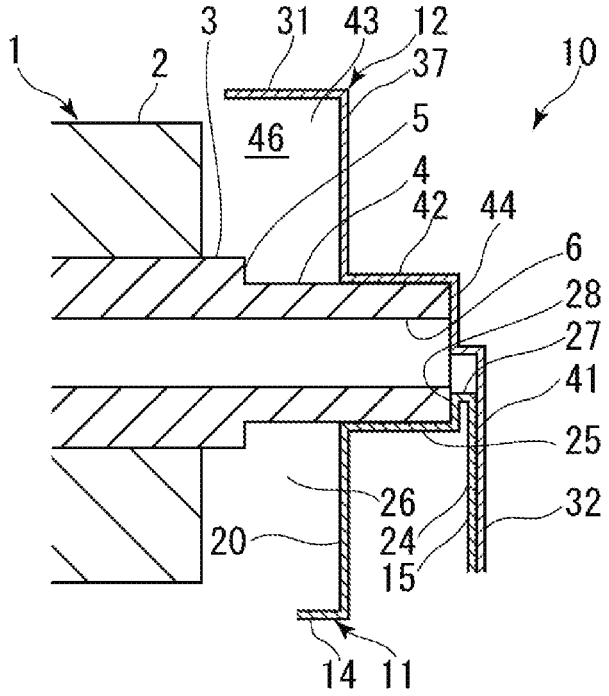
[Fig. 6]
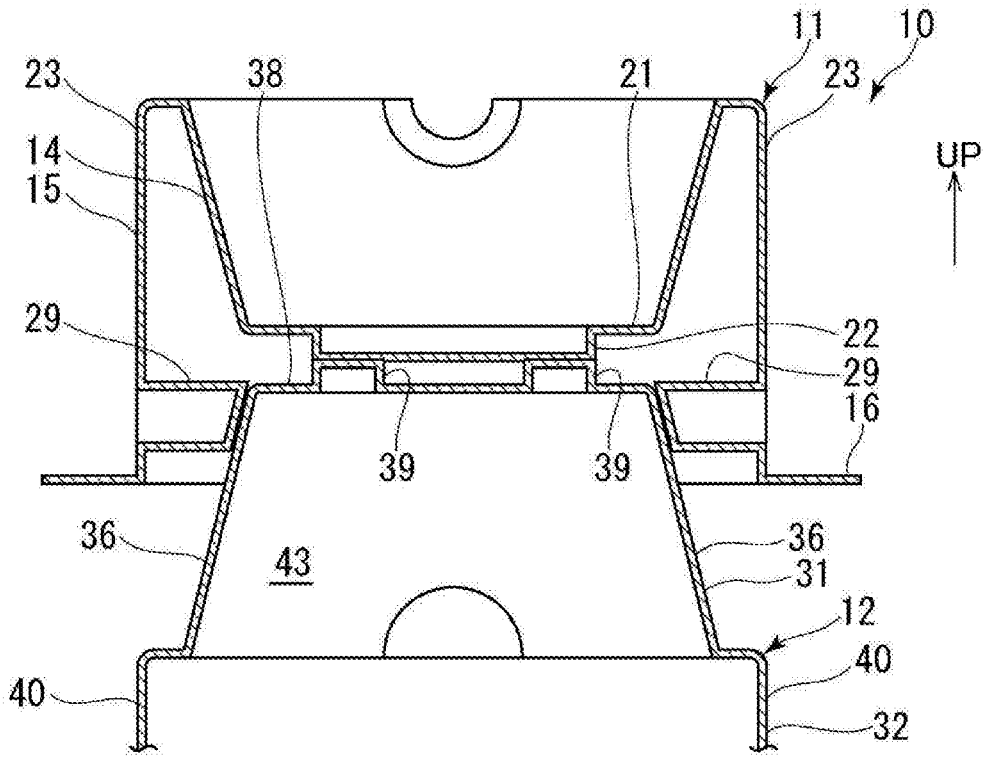

[Fig. 7]
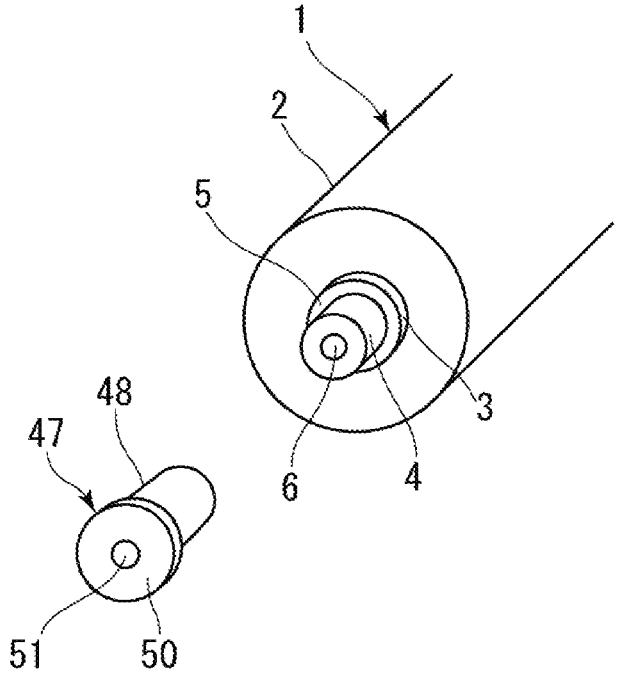
[Fig. 8]
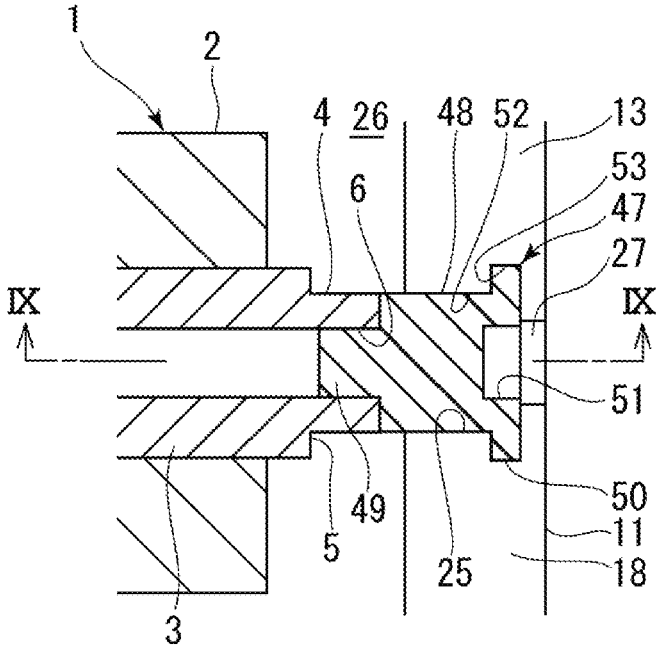

[Fig. 9]
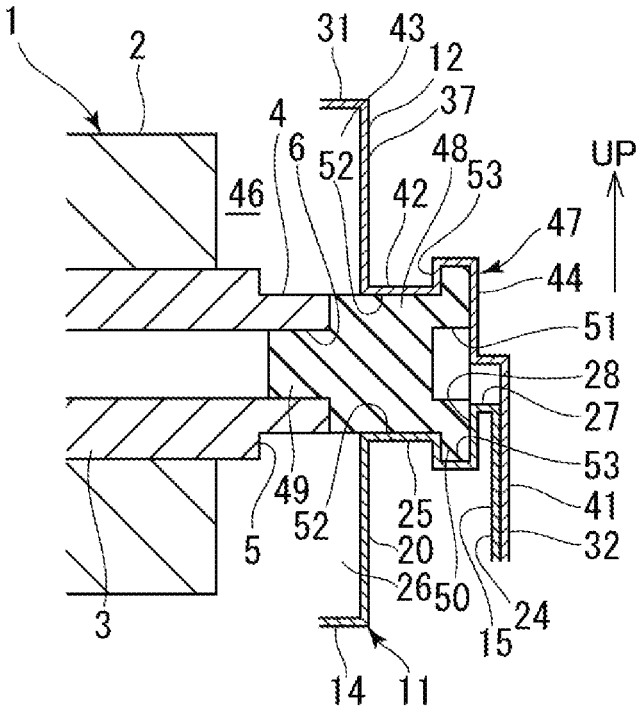
[Fig. 10]
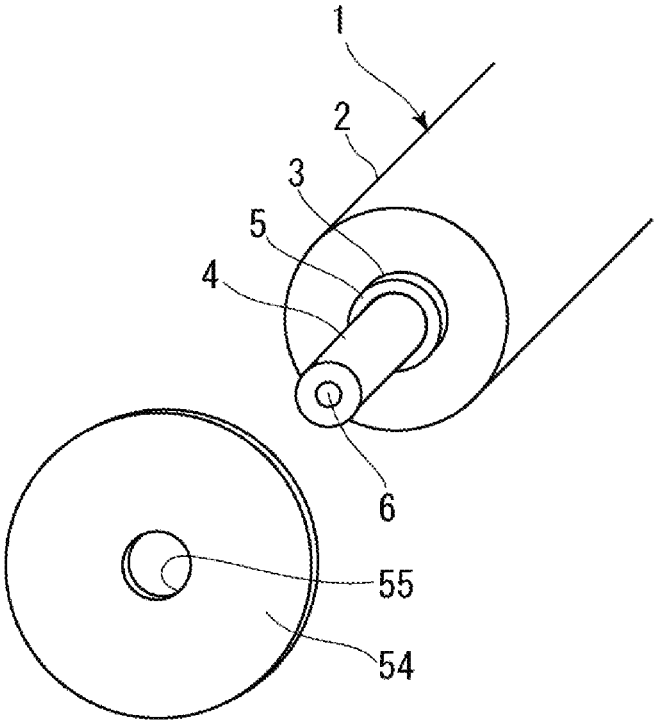

[Fig. 11]
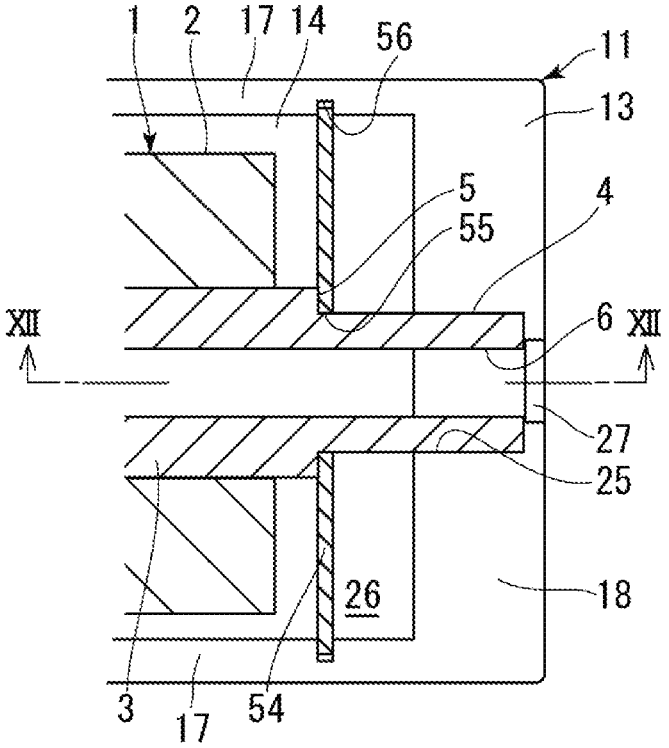
[Fig. 12]
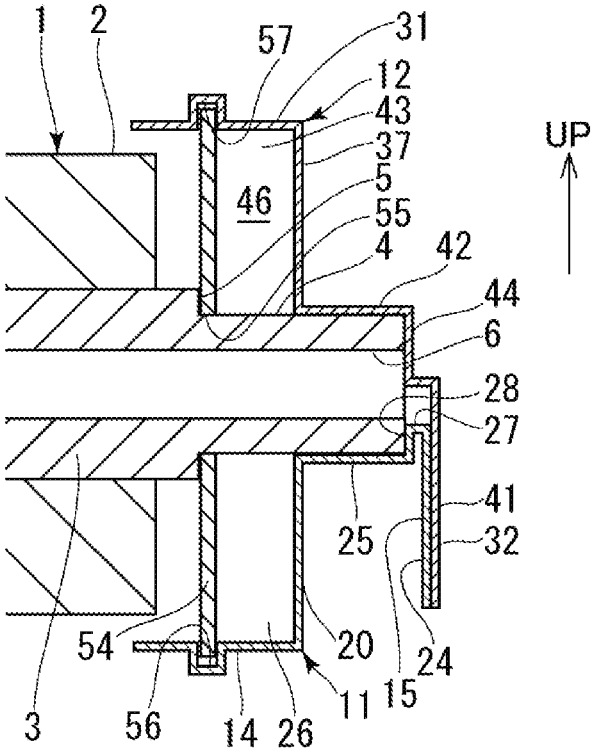

[Fig. 13]
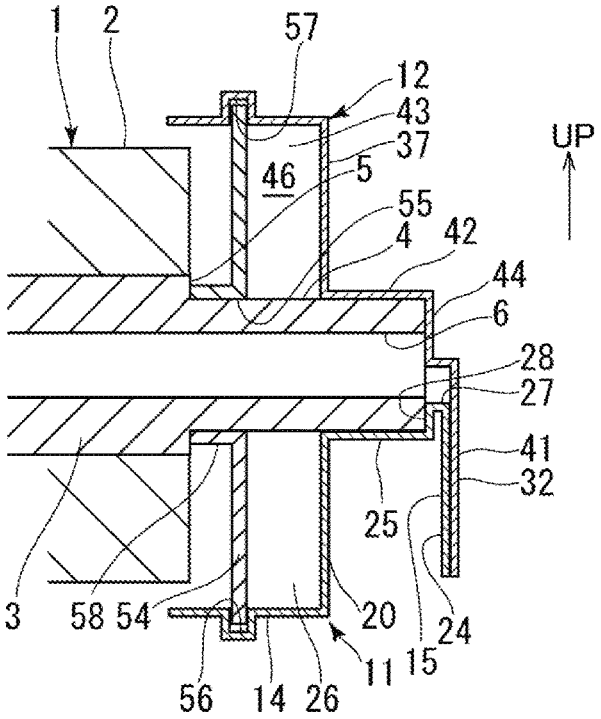
[Fig. 14]
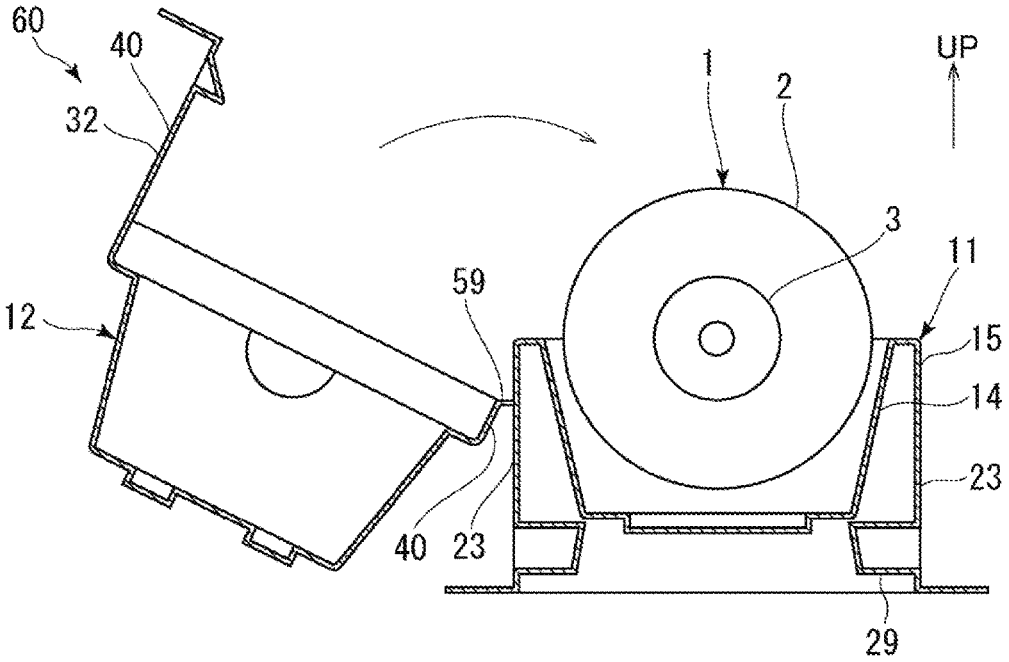

[Fig. 15]
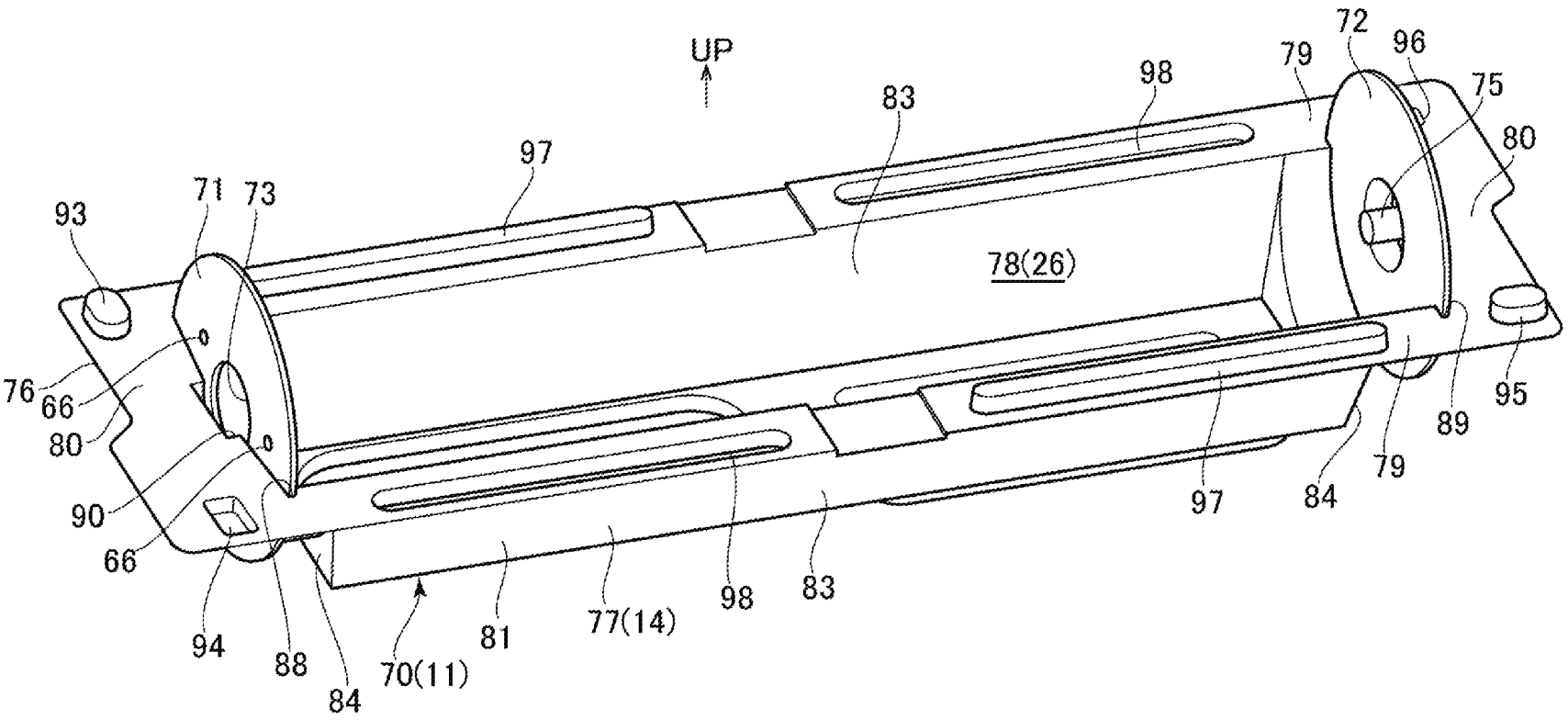

[Fig. 16]
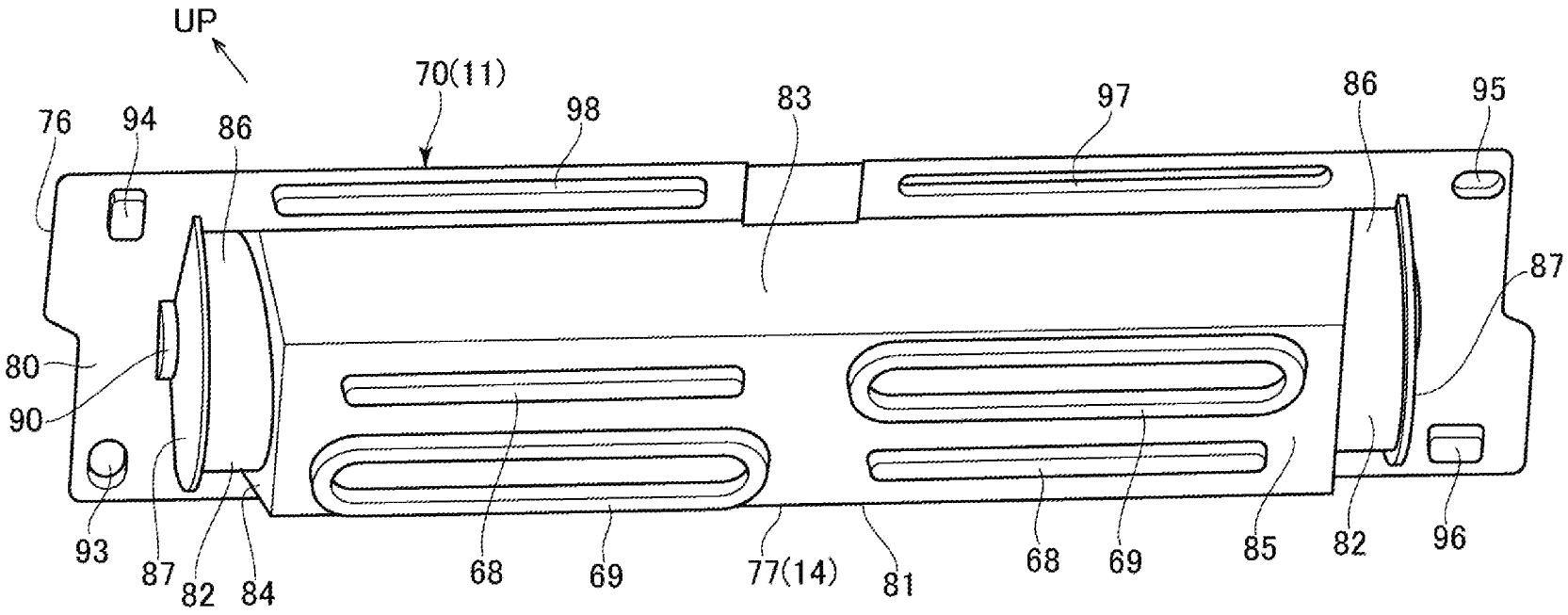

[Fig. 17]
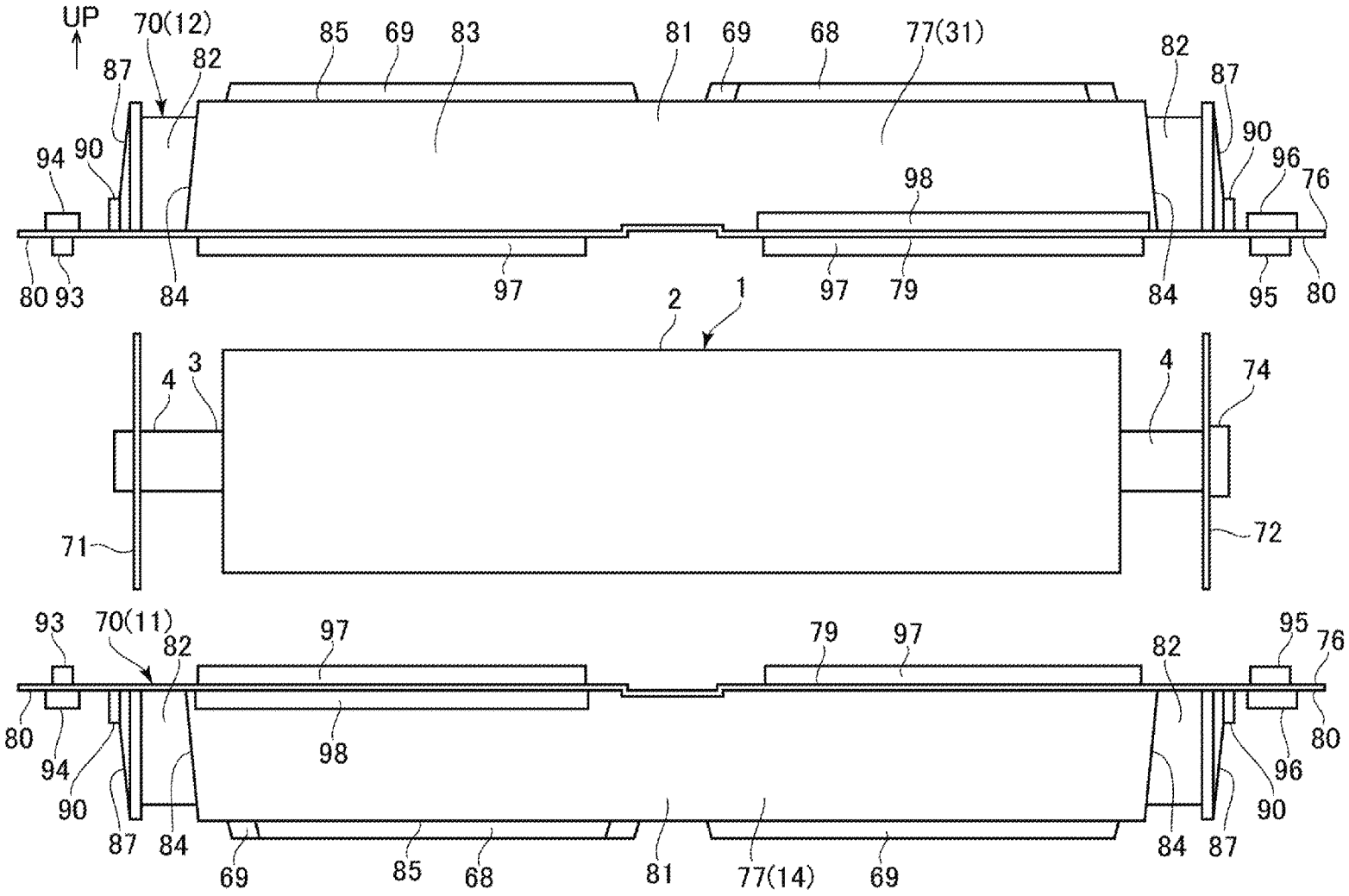

[Fig. 18]
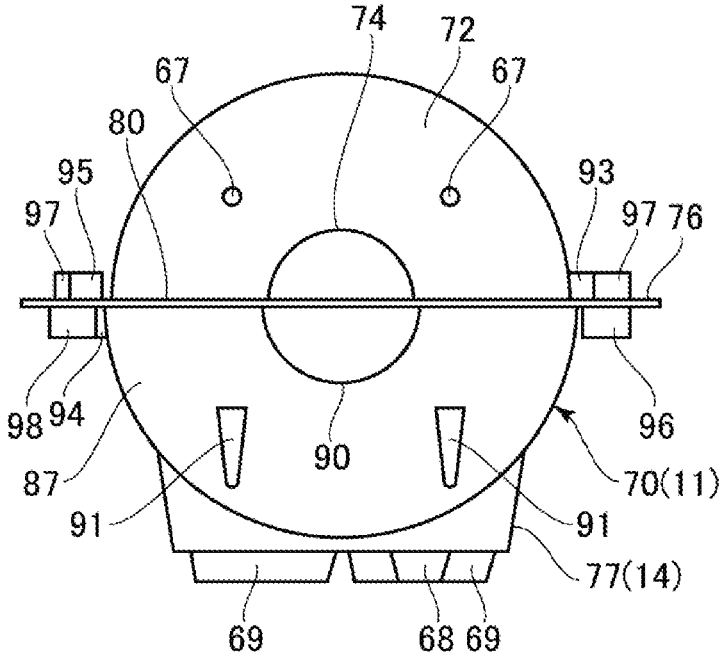
[Fig. 19]
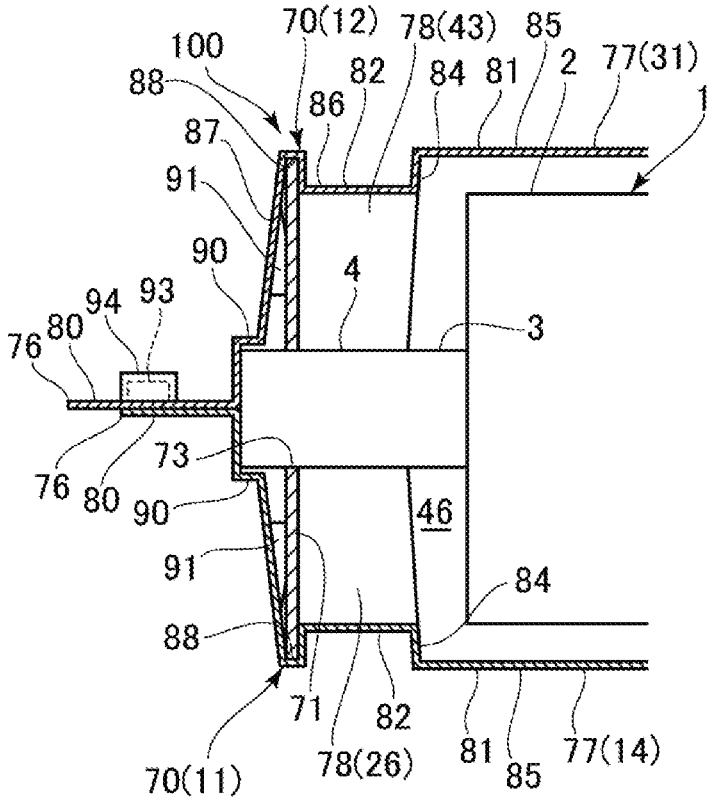

[Fig. 20]
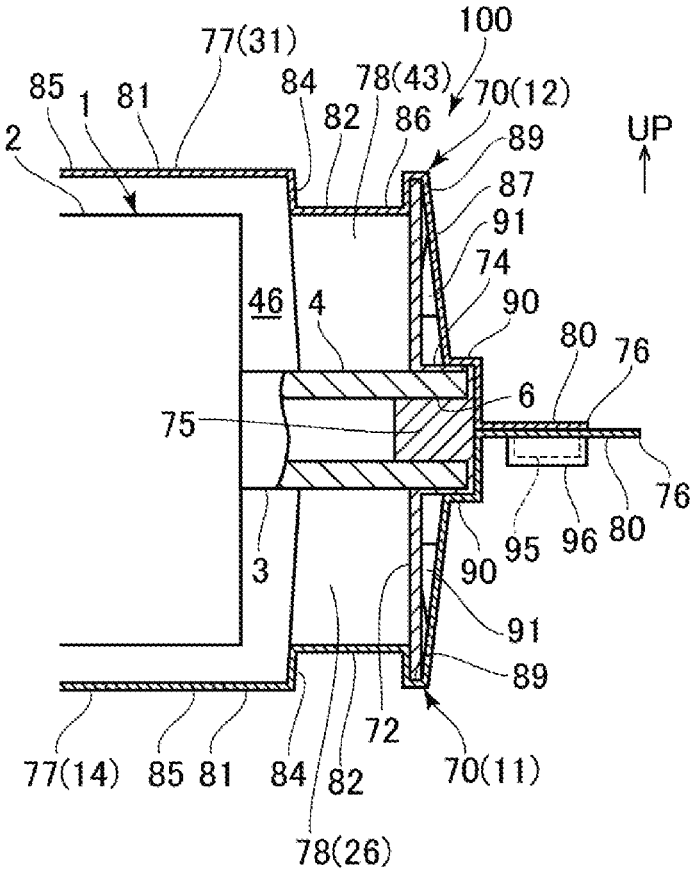
[Fig. 21]
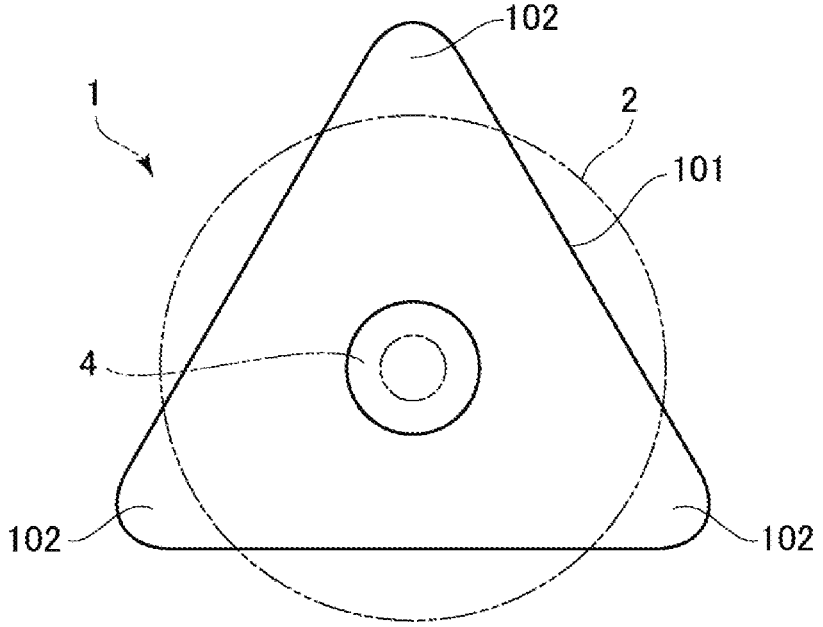

[Fig. 22]
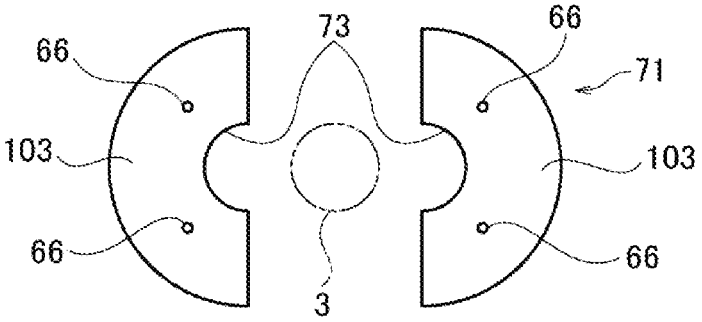
[Fig. 23]
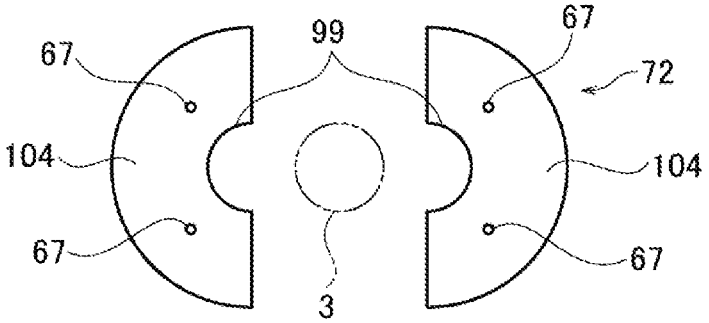
[Fig. 24]
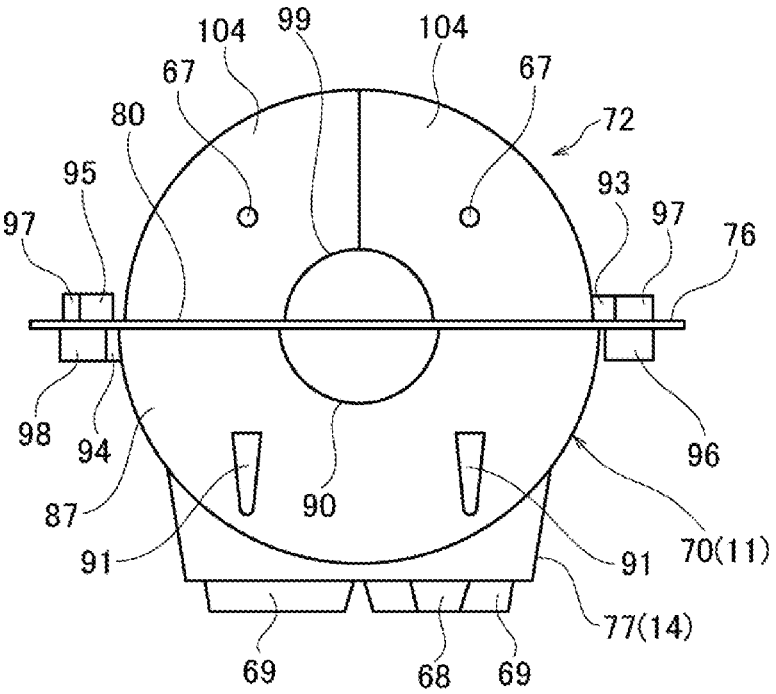

ROLLER CASE

CROSS REFERENCE TO RELATED APPLICATIONS

This application is a National Stage of International Application No. PCT/JP2018/014537 filed Apr. 5, 2018, claiming priority based on Japanese Patent Application No. 2017-076218 filed Apr. 6, 2017.

TECHNICAL FIELD

The present invention relates to roller cases for storing a roller in which a roller main body made of elastic porous material is supported by a rotation shaft.

BACKGROUND ART

Patent Literature 1 discloses a tubular shipping container having a cap. This tubular shipping container includes a rigid structural body in an approximately cylindrical shape to surround and protect a brush and defines an inner cavity having a cavity opening. The cap is configured to be joined to the tubular shipping container at the cavity opening to enclose or cap an end of the tubular shipping container.

CITATION LIST

Patent Literature

Patent Literature 1: Published Japanese Translation of PCT International Application No. 2015-532246

SUMMARY OF INVENTION

Technical Problem

For the tubular shipping container in Patent Literature 1, when a brush (a roller main body made of elastic porous material) is stored into the tubular shipping container, or when a stored brush is taken out of the tubular shipping container, the brush needs to be moved along the axis direction between the inner cavity and the outside via the cavity opening. Hence, the storing or taking-out work is troublesome. In addition, when a brush is put in or taken out, the brush may come into contact with the tubular shipping container, causing deformation, damage, or dirt on the brush.

Hence, an object of the present invention is to provide a roller case with which storing or taking-out work is easy and which surely prevents deformation, damage, or dirt on the roller main body when the roller is put in or taken out.

Solution to Problem

To achieve the above object, a first aspect of the present invention is a roller case for storing a roller, including a first case body and a second case body. The roller has a roller main body and a rotation shaft. The roller main body is made of elastic porous material and has a cylindrical shape. The inner peripheral surface of the roller main body is supported by the outer peripheral surface of the rotation shaft.

The first case body includes first support portions on one side and the other side capable of supporting one end and the other end of the rotation shaft from one direction of an axis crossing direction intersecting an axis direction of the rotation shaft, and a first cover portion forming a first containing space that is open on the other side in the axis crossing direction between the first support portion on the one side the first support portion on the other side. The a second case body includes second support portions on one side and the other side capable of supporting the one end and the other end of the rotation shaft from the other direction of the axis crossing direction, and a second cover portion forming a second containing space that is open on the one side in the axis crossing direction between the second support portion on the one side and the second support portion on the other side. The second case body is configured to be engaged with the first case body in a case-closed state where the first containing space and the second containing space form a roller-main-body containing space and is capable of keeping the case-closed state.

In a roller-stored state where the roller is stored, the case-closed state is kept by the engagement between the first case body and the second case body, the roller main body is contained in the roller-main-body containing space, being spaced from the first case body and the second case body, the one end and the other end of the rotation shaft are clamped in the axis crossing direction and held between the first support portions and the second support portions, and the entire roller is covered with the first case body and the second case body.

In the above configuration, when a roller is stored into the roller case, the roller case is put into a case-open state where the engagement between the first case body and the second case body is released and where the roller-main-body containing space is open. Then, for example, the first case body is held in the orientation in which the first containing space is open upward, and the roller is moved from above down to the first case body. One end and the other end of the rotation shaft are placed on the first support portions on one side and the other side. In this rotation-shaft-placed state, the lower part of the roller main body is housed in the first containing space, and the lower area of the outer peripheral surface of the roller main body is covered with the first cover portion without being in contact with it. Next, the second case body is put on the first case body from above, and the second case body is engaged with the first case body. In this roller-stored state (the case-closed state in which a roller is stored), the upper part of the roller main body is housed in the second containing space, the upper area of the outer peripheral surface of the roller main body is covered with the second cover portion without being in contact with it, and the roller main body is contained in the roller-main-body containing space. In the roller-stored state, one end and the other end of the rotation shaft are clamped in the axis crossing direction and held between the first support portion and the second support portion, and the entire roller is covered with the first case body and the second case body. Conversely, when a roller is taken out of the roller case, the engagement between the first case body and the second case body is released to put the roller case into the case-open state. Then, for example, one end and the other end of the rotation shaft are supported with fingertips of both hands to pull up the roller (the rotation shaft), and the roller is taken out of the first case body. As described above, since when a roller is stored into the roller case, or when a stored roller is taken out of the roller case, the roller is moved not in the axis direction but in an axis crossing direction, storing or taking-out work can be performed easily. In addition, the roller main body does not easily come into contact with the roller case (the first case body) when being stored or taken out, and thus it is possible to surely prevent deformation, damage, or dirt on the roller main body.

A second aspect of the present invention is the roller case according to the first aspect, in which at at least the one end of the rotation shaft, a shaft attachment member that is detachably attached to the rotation shaft is clamped and held between the first support portion on the one side and the second support portion on the one side.

The above configuration makes it possible to support the rotation shaft on one end side via the shaft attachment member in the case where the end face of the rotation shaft on the one end side does not protrude long enough from the end face of the roller main body.

A third aspect of the present invention is the roller case according to the first aspect, in which at at least the one end of the rotation shaft, a shaft end portion of the rotation shaft, protruding from an end face of the roller main body, is clamped and held between the first support portion on the one side and the second support portion on the one side. The first support portion on the one side has a groove shape on which an outer peripheral surface of the shaft end portion is placeable. The first case body has an open groove arranged on the opposite side of the first support portion on the one side from the first containing space and adjoining to the first support portion on the one side. The open groove has a groove shape through which the shaft end portion placed on the first support portion on the one side is not allowed to pass and through which the end face of the shaft end portion placed on the first support portion on the one side is exposed to the outside.

A fourth aspect of the present invention is the roller case according to the second aspect, in which the first support portion on the one side has a groove shape on which an outer peripheral surface of the shaft attachment member is placeable. The first case body has an open groove arranged on the opposite side of the first support portion on the one side from the first containing space and adjoining to the first support portion on the one side. The open groove has a groove shape through which the shaft attachment member placed on the first support portion on the one side is not allowed to pass and through which the end face of the shaft attachment member placed on the first support portion on the one side is exposed to the outside.

For the above configuration, by forming the open groove such that it has a size that allows the operator's fingertip to be inserted, the operator, when storing or taking out a roller, can move up or down the rotation shaft (roller) with his/her fingertips in contact with the end faces of the shaft end portions or the end faces of the shaft attachment members from the axis direction. This improves the workability.

A fifth aspect of the present invention is the roller case according to the first aspect, in which at at least the one end of the rotation shaft, a shaft end portion of the rotation shaft protruding from an end face of the roller main body is clamped and held between the first support portion on the one side and the second support portion on the one side. An outer peripheral surface of the shaft end portion has a protrusion-and-recess shape. At least one of the first support portion on the one side and the second support portion on the one side has a protrusion-and-recess shape that is engaged with the protrusion-and-recess shape of the shaft end portion to restrict the movement of the shaft end portion.

A sixth aspect of the present invention is the roller case according to the second aspect, in which an outer peripheral surface of the shaft attachment member has a protrusion-and-recess shape. At least one of the first support portion on the one side and the second support portion on the one side has a protrusion-and-recess shape that is engaged with the protrusion-and-recess shape of the shaft attachment member to restrict the movement of the shaft attachment member.

Since in the above configuration, the movement of the shaft end portion or the shaft attachment member is restricted by the engagement with the first support portion on one side and/or the second support portion on the one side, it is possible to surely prevent deformation, damage, or dirt on the roller main body, resulting from contact with the roller case in a case where a roller stored in the roller case is transported or the like cases.

A seventh aspect of the present invention is the roller case according to the first aspect, in which a shaft-drop restricting member is detachably attached to at least the one end of the rotation shaft. Approximately the entire area of an outer peripheral edge of the shaft-drop restricting member attached to the rotation shaft protrudes outward in radial directions of the roller main body beyond an outer peripheral surface of the roller main body. At least one of the first case body and the second case body has a shaft-drop-restricting-member engagement groove that is engaged with the outer peripheral edge of the shaft-drop restricting member to restrict the movement of the shaft-drop restricting member in the axis direction.

For the above configuration, in a case where an unintended external force acts on the roller case in the roller-stored state and where holding of one end of the rotation shaft by the first support portion the second support portion is released, the interference between the roller main body and the roller case when the rotation shaft moves down relative to the roller case can be blocked by the shaft-drop restricting member. Thus, it is possible to surely prevent deformation, damage, or dirt on the roller main body, resulting from contact with the roller case in a case where a roller is stored into the roller case and transported or the like cases.

An eighth aspect of the present invention is the roller case according to the second aspect, in which approximately the entire area or multiple areas of an outer peripheral edge of the shaft attachment member attached to the rotation shaft protrude outward in radial directions of the roller main body beyond an outer peripheral surface of the roller main body. An area of the shaft attachment member, protruding beyond the outer peripheral surface of the roller main body is clamped and held between the first support portion and the second support portion.

For the above configuration, since one end of the rotation shaft is held by the shaft attachment member being clamped at areas protruding beyond the outer peripheral surface of the roller main body between the first support portion the second support portion, holding of the one end of the rotation shaft is not easily released in a case where an unintended external force acts on the roller case in the roller-stored state. Thus, it is possible to surely prevent deformation, damage, or dirt on the roller main body, resulting from contact with the roller case in a case where a roller is stored into the roller case and transported or the like cases.

A ninth aspect of the present invention is the roller case according to the seventh aspect, in which the shaft-drop restricting member includes a combination of multiple divided plates detachable from the rotation shaft by being separated in the axis crossing direction.

For the above configuration, the shaft-drop restricting member can be attached to the rotation shaft by assembling multiple divided plates to the rotation shaft in the axis crossing direction, and the shaft-drop restricting member can be removed from the rotation shaft by separating and detaching the multiple divided plates from the rotation shaft in the axis crossing direction. Thus, the work for attaching or detaching the shaft-drop restricting member can be performed more easily than in the case where a shaft-drop restricting member has a shaft-passing hole, where the shaft-drop restricting member is attached to the rotation shaft by passing the rotation shaft through the shaft-passing hole, and where the shaft-drop restricting member is removed by pulling the rotation shaft out of the shaft-passing hole.

Advantageous Effects of Invention

The roller case according to the present invention makes it possible to surely prevent deformation, damage, or dirt on the roller main body when a roller is put in or taken out.

BRIEF DESCRIPTION OF DRAWINGS

FIG. 1 is a perspective view of a roller case according to a first embodiment of the present invention before a roller is stored in the roller case.

FIG. 2(*a*) is a plan view of the lower case in FIG. 1 in a shaft-placed state; FIG. 2(*b*) is a plan view of the roller case in FIG. 1 in a roller-stored state.

FIG. 3 is a cross-sectional view from arrows III-III in FIG. 2(*b*).

FIG. 4 is a cross-sectional view from arrows IV-IV in FIG. 2(*b*).

FIG. 5 is a cross-sectional view from arrows V-V in FIG. 3.

FIG. 6 is a cross-sectional view of an upper case and the lower case with the upper case placed on top of the lower case.

FIG. 7 is a perspective view of an adapter according to a second embodiment and a roller.

FIG. 8 is a cross-sectional plan view of a main part of the second embodiment.

FIG. 9 is a cross-sectional view from arrows IX-IX in FIG. 8.

FIG. 10 is a perspective view of a flange according to a third embodiment and a roller.

FIG. 11 is a cross-sectional plan view of a main part of the third embodiment.

FIG. 12 is a cross-sectional view from arrows XII-XII in FIG. 11.

FIG. 13 is a cross-sectional view of a modification of the third embodiment.

FIG. 14 is a cross-sectional view of a fourth embodiment.

FIG. 15 is a perspective view of a case body and flange according to a fifth embodiment when viewed obliquely from above.

FIG. 16 is a perspective view of the case body in FIG. 15 from obliquely below.

FIG. 17 is a side view of a roller case according to the fifth embodiment before a roller is stored.

FIG. 18 is a rear view of the first case body in FIG. 17 after a roller is stored.

FIG. 19 is a cross-sectional side view of the fifth embodiment on one end side.

FIG. 20 is a cross-sectional side view of the fifth embodiment on the other end side.

FIG. 21 is a front view of a modification of a flange of the fifth embodiment.

FIG. 22 is a front view of a front flange according to a sixth embodiment.

FIG. 23 is a front view of a rear flange according to the sixth embodiment.

FIG. 24 is a rear view of a first case body after a roller is stored for the case where the rear flange in FIG. 23 is attached.

DESCRIPTION OF EMBODIMENTS

A roller case 10 according to a first embodiment of the present invention will be described with reference to FIGS. 1 to 6.

As illustrated in FIGS. 1 to 5, the roller case 10 is used in the case of transporting (shipping) or storing a manufactured roller 1 and other cases, as a container for protecting the roller 1. The roller 1 is what is called a roller with a shaft in which the inner peripheral surface of a cylindrical roller main body 2 is fixedly supported by the outer peripheral surface of a rotation shaft 3. Note that in the following description, the up-down direction means an approximately vertical direction, the front-rear direction means the axis direction of the rotation shaft 3 which is approximately orthogonal to the up-down direction, and the right-left direction means the direction approximately orthogonal to the up-down direction and the front-rear direction. Each direction is defined assuming the state where the rotation shaft 3 of the roller 1 stored in the roller case 10 extends approximately horizontally. In addition, the axially inner side is a direction toward the center of the rotation shaft 3 in the axis direction (for the roller case 10, the direction corresponding to this direction), and the axially outer side is a direction away from the center of the rotation shaft 3 in the axis direction (for the roller case 10, the direction corresponding to this direction), The roller main body 2 is formed of a soft porous material having elasticity. The outer peripheral surface of the roller main body 2 may be a curved shape or may be a shape having protrusions and pits such as one having a large number of protrusions protruding from a curved surface. For the soft porous material, a polymer compound porous material is used, for example, a polyvinyl acetal based porous material (PV At based porous material) having elasticity in a water containing condition, a polyurethane based porous material having elasticity in both dry and water containing conditions, or the like.

The rotation shaft 3 has, for example, an approximately cylindrical column shape or approximately cylindrical tubular shape having an outer diameter larger than or equal to the inner diameter of the roller main body 2 and is inserted into the inner diameter portion of the roller main body 2 to hold the roller main body 2. The rotation shaft 3 is formed of a hard material such as metal, plastic, or the like and has shaft end portions 4 integrally provided at one end (front end) and the other end (rear end) of the rotation shaft 3. The shaft end portions 4 extend in the axis direction of the rotation shaft 3 and protrude from both end faces (front and rear end faces) of the roller main body 2. Note that the cross-sectional shape of the outer periphery of the rotation shaft 3 is not limited to a circle but may be, for example, a polygon, a shape having protrusions and recesses, and the like. The roller main body 2 may be held by the rotation shaft 3 only with the frictional force between the roller main body 2 and the rotation shaft 3 or may be held by the rotation shaft 3 with an adhesive or the like. In the case where the porous material (the roller main body 2) is manufactured by solidifying liquid (a liquid mixture) containing the raw material in a mold, the roller main body 2 may be held by the rotation shaft 3 by solidifying the liquid mixture with the rotation shaft 3 set in the mold (by forming the roller main body 2 integrally on the rotation shaft 3, instead of inserting the rotation shaft 3 into a manufactured roller main body 2).

The shaft end portions 4 of the present embodiment have diameters smaller than the center portion of the rotation shaft 3 that holds the roller main body 2, and steps 5 are formed between the center portion and the shaft end portions 4. On the end faces of the shaft end portions 4 are shaft-end-face holes 6 formed to have circular cross sections.

The roller case 10 includes a first case body (lower case) 11 that is positioned on the lower side and a second case body (upper case) 12 that is positioned on the upper side. The first case body 11 and the second case body 12 are made of resin, and each part of them is integrally formed in a thin plate shape by vacuum forming or the like. The roller case 10 of the present embodiment has a thickness that is elastically deformed and recessed when the surface is pressed by a fingertip. Examples of resins used to form the second case body 12 and the first case body 11 include polyethylene terephthalate (PET), polystyrene (PS), polypropylene (PP), polyethylene (PE), acrylonitrile butadiene styrene (ABS), polycarbonate (PC), and polyvinyl chloride (PVC). Note that in the case where a transparent or semitransparent resin is used to form the first case body 11 and/or the second case body 12, the content (roller 1) is exposed to the outside.

The first case body 11 integrally has a first base-face portion 13 in a rectangular frame shape (a picture frame shape), a first cover portion 14 recessed downward from the inner peripheral edge of the first base-face portion 13, a first outer-peripheral-face portion 15 extending downward from the outer peripheral edge of the first base-face portion 13 and covering the outer side of the first cover portion 14, and a first edge-face portion 16 extending outward from the lower end peripheral edge of the first outer-peripheral-face portion 15.

The first base-face portion 13 has a pair of right and left first base-long-face portions 17 which are the long sides of the rectangular frame and a pair of front and rear first base-short-face portions 18 which are the short sides of the rectangular frame. The first base-long-face portion 17 extends in the front-rear direction along the axis direction of the roller 1 (rotation shaft 3). The first base-short-face portion 18 extends in the right-left direction along an axis crossing direction (radial direction) approximately orthogonal to the axis direction of the roller The first cover portion 14 has a pair of right and left first cover long-face portions 19, a pair of front and rear first cover short-face portions 20, and a cover bottom-face portion 21. The first cover long-face portion 19 has a rectangular shape extending downward from the inner edge of the first base-long-face portion 17. The first cover short-face portion 20 has a rectangular shape curved from the end edges of the adjoining first cover long-face portions 19 and extending downward from the inner edge of the first base-short-face portion 18. The cover bottom-face portion 21 has a rectangular shape that closes the lower end of the rectangular tubular shape formed by the first cover long-face portions 19 and the first cover short-face portions 20. The cover bottom-face portion 21 has multiple first ribs 22 for reinforcement formed to protrude downward.

The first outer-peripheral-face portion 15 has a pair of right and left first outer long-face portions 23 and a pair of front and rear first outer short-face portions 24. The first outer long-face portion 23 has a rectangular shape extending downward from the outer edge of the first base-long-face portion 17. The first outer short-face portion 24 has a rectangular shape curved from the end edges of the adjoining first outer long-face portions 23 and extending downward from the outer edge of the first base-short-face portion 18.

The front and rear first base-short-face portions 18 each have a first shaft-facing groove (first support portion) 25 having a groove shape, formed to be recessed downward in an arc shape. The first shaft-facing groove 25 is formed to fit the outer periphery of the shaft end portion 4 of the rotation shaft 3, and the front and rear shaft end portions 4 of the rotation shaft 3 are placed on the respective first shaft-facing grooves 25. The first cover portion 14 forms a first containing space 26 open upward between the front and rear first shaft-facing grooves 25. The axially inner sides of the first shaft-facing grooves 25 are open into the first containing space 26. Note that the inner diameter of the first shaft-facing groove 25 may have any size that the shaft end portion 4 can enter. It may be smaller than the outer diameter of the shaft end portion 4 as long as the shaft end portion 4 can enter the first shaft-facing groove 25 by elastically deforming the first case body 11. In addition, the shape of the first shaft-facing groove 25 is not limited to an arc shape but may be any shape capable of supporting the shaft end portion 4.

The front and rear first base-short-face portions 18 each have an open groove 27 formed to be on the axially outer side (the opposite side from the first containing space 26) of the first shaft-facing groove 25. The open groove 27 has a groove shape recessed downward in an arc shape and adjoins (continues to) the first shaft-facing groove 25. The inner diameter of the open groove 27 is set smaller than the inner diameter of the first shaft-facing groove 25. Between the first shaft-facing groove 25 and the open groove 27 is a groove boundary 28 formed in a step shape. The groove boundary 28 restricts the movement in the axially outward direction of the shaft end portion 4 placed in the first shaft-facing groove 25, so that the shaft end portion 4 cannot pass through the open groove 27 adjoining to the first shaft-facing groove 25. However, the end face of the shaft end portion 4 is exposed to the outside via the adjoining open groove 27. The inner diameter of the open groove 27 is set to have a size into which a fingertip of the operator can be inserted, so that the operator can touch with a fingertip the end face of the shaft end portion 4 placed in the first shaft-facing groove 25 via the open groove 27.

The right and left first outer long-face portions 23 each have engagement recesses 29 formed to be recessed inward (toward the opposite first outer long-face portion 23).

The second case body 12 integrally has a second base-face portion 30 in a rectangular frame shape (a picture frame shape), a second cover portion 31 protruding upward from the inner peripheral edge of the second base-face portion 30, a second outer-peripheral-face portion 32 extending downward from the outer peripheral edge of the second base-face portion 30, and a second edge-face portion 33 extending outward from the lower end peripheral edge of the second outer-peripheral-face portion 32.

The second base-face portion 30 has a pair of right and left second base-long-face portions 34 which are the long sides of the rectangular frame and a pair of front and rear second base-short-face portions 35 which are the short sides of the rectangular frame. The second base-long-face portion 34 extends in the front-rear direction along the axis direction, and the second base-short-face portion 35 extends in the right-left direction along an axis crossing direction.

The second cover portion 31 has a pair of right and left second cover long-face portions 36, a pair of front and rear second cover short-face portions 37, and a cover top-face portion 38. The second cover long-face portion 36 has a rectangular shape extending upward from the inner edge of the second base-long-face portion 34. The second cover short-face portion 37 has a rectangular shape curved from the end edges of the adjoining second cover long-face portions 36 and extending upward from the inner edge of the second base-short-face portion 35. The cover top-face portion 38 has a rectangular shape that closes the upper end of the rectangular tubular shape formed by the second cover long-face portions 36 and the second cover short-face portions 37. The cover top-face portion 38 has multiple second ribs 39 for reinforcement formed to protrude upward.

The second outer-peripheral-face portion 32 has a pair of right and left second outer long-face portions 40 and a pair of front and rear second outer short-face portions 41. The second outer long-face portion 40 has a rectangular shape extending downward from the outer edge of the second base-long-face portion 34. The second outer short-face portion 41 has a rectangular shape curved from the end edges of the adjoining second outer long-face portions 40 and extending downward from the outer edge of the second base-short-face portion 35.

The front and rear second base-short-face portions 35 each have a second shaft-facing groove (second support portion) 42 having a groove shape, formed to be recessed upward in an arc shape. The second cover portion 31 forms a second containing space 43 open downward between the front and rear second shaft-facing grooves 42. The axially inner side of the second shaft-facing groove 42 is open to the second containing space 43, and the axially outer side (the opposite side from the second containing space 43) of the second shaft-facing groove 42 is closed by a groove end 44. The second shaft-facing groove 42 is formed to fit the outer periphery of the shaft end portion 4 of the rotation shaft 3. Note that the inner diameter of the second shaft-facing groove 42 may have any size that the shaft end portion 4 can enter. It may be smaller than the outer diameter of the shaft end portion 4 as long as the shaft end portion 4 can enter the second shaft-facing groove 42 by deforming the second case body 12. In addition, the shape of the second shaft-facing groove 42 is not limited to an arc shape but may be any shape capable of supporting the shaft end portion 4, To make it possible to insert the first cover portion 14 into the inner space of the second outer-peripheral-face portion 32, the distance between the inner faces of the right and left second outer long-face portions 40 is set approximately equal to or a little longer than the distance between the outer faces of the right and left first outer long-face portions 23, and the distance between the inner faces of the front and rear second outer short-face portions 41 is set approximately equal to or a little longer than the distance between the outer faces of the front and rear first outer short-face portions 24. The right and left second outer long-face portions 40 each have locking protrusions 45 formed to protrude inward (toward the opposite second outer long-face portion 40). Note that as long as the first cover portion 14 can be inserted into the inner space of the second outer-peripheral-face portion 32 by elastically deforming the first case body 11 and/or the second case body 12, the distance between the inner faces of the right and left second outer long-face portions 40 may be shorter than the distance between the outer faces of the right and left first outer long-face portions 23, and the distance between the inner faces of the front and rear second outer short-face portions 41 may be shorter than the distance between the outer faces of the front and rear first outer short-face portions 24.

The first case body 11 is placed in the orientation in which the first containing space 26 is open upward (basic orientation), and the second case body 12 is placed on top of the first case body 11 and pushed down such that the first outer-peripheral-face portion 15 is inserted into the inner space of the second outer-peripheral-face portion 32. The locking protrusions 45 of the second case body 12 are engaged with the engagement recesses 29 of the first case body 11, and the roller case 10 is put into the case-closed state. The case-closed state is kept by the engagement between the locking protrusions 45 and the engagement recesses 29. In the case-closed state, the first base-face portion 13 and the second base-face portion 30 faces each other being close to or in contact with each other, and the first containing space 26 and the second containing space 43 form a roller-main-body containing space 46. The axially outer sides of the open grooves 27 are closed by the second outer short-face portions 41 of the second case body 12 (see FIG. 5).

In the case-open state where the engagement of the locking protrusions 45 and the engagement recesses 29 is released, where the first case body 11 and the second case body 12 are separated, and where the roller-main-body containing space 46 is open, the shaft end portions 4 at the front end and rear end of the rotation shaft 3 are placed on the front and rear first shaft-facing grooves 25 of the first case body 11 in the basic orientation, and then, the second case body 12 is placed on top of the first case body 11 to put the roller case 10 into the case-closed state. This is the roller-stored state where the roller 1 is stored in the roller case 10. In the roller-stored state, the roller main body 2 is contained in the roller-main-body containing space 46, being spaced from the first case body 11 and the second case body 12. The shaft end portions 4 at the front end and rear end are clamped in an axis crossing direction and held between the first shaft-facing groove 25 and the second shaft-facing groove 42, and the entire roller 1 is covered by the first case body 11 and the second case body 12. The movement of the rotation shaft 3 in the axis crossing direction is blocked by the first shaft-facing grooves 25 and the second shaft-facing grooves 42, and the movement of the rotation shaft 3 in the axis direction is blocked by the groove boundaries 28 and the groove ends 44.

As illustrated in FIG. 6, when the second case body 12 is placed in the orientation in which the second containing space 43 is open downward, and the first case body 11 is placed on top of the second case body 12 such that the second cover portion 31 is inserted into an inner space of the first outer-peripheral-face portion 15, the first ribs 22 of the first case body 11 are placed on top of the second ribs 39 of the second case body 12 from above, and the second cover portion 31 of the second case body 12 is inserted into and engaged with the inner portions of the right and left the engagement recesses 29 of the first case body 11. This engagement makes stable the stacking state of the first case body 11 and the second case body 12, making it possible to stack multiple roller cases 10 in the roller-stored state.

When the roller 1 is stored into the roller case 10, the roller case 10 is put into the case-open state. The first case body 11 is placed in the standard orientation in which the first containing space 26 is open upward. The roller 1 is moved from above down to the first case body 11. The front and rear shaft end portions 4 of the roller 1 are placed on the front and rear first shaft-facing grooves 25, respectively. In this rotation-shaft-placed state, the lower part of the roller main body 2 is housed in the first containing space 26, and the lower area of the outer peripheral surface of the roller main body 2 is covered with the first cover portion 14 without being in contact with it. Next, the second case body 12 is put on the first case body 11 from above, and the locking protrusions 45 of the second case body 12 are engaged with the engagement recesses 29 of the first case body 11. In this roller-stored state (the case-closed state with the roller 1 stored), the upper part of the roller main body 2 is housed in the second containing space 43, the upper area of the outer peripheral surface of the roller main body 2 is covered with the second cover portion 31 without being in contact with it, and the roller main body 2 is contained in the roller-main-body containing space 46. In the roller-stored state, the front and rear shaft end portions 4 are clamped in the up-down direction and held between the front and rear first shaft-facing grooves 25 and the front and rear second shaft-facing grooves 42, and the entire roller 1 is covered with the first case body 11 and the second case body 12.

When the roller 1 is taken out of the roller case 10, the second case body 12 is lifted up to be separated from the first case body 11, the engagement between the engagement recesses 29 of the first case body 11 and the locking protrusions 45 of the second case body 12 is released, and thus, the roller case 10 is put into the case-open state. The front and rear shaft end portions 4 of the rotation shaft 3 are supported by fingertips of both hands, and the roller 1 (rotation shaft 3) is pulled up. Then, the roller 1 is taken out of the first case body 11.

In the case of storing the roller 1 into the roller case 10 or taking a stored roller 1 out of the roller case 10 as described above, storing or taking-out work can be performed easily because the roller 1 is moved not in the axis direction (the front-rear direction) but in an axis crossing direction (the up-down direction). In addition, the roller main body 2 does not easily come into contact with the roller case 10 (first case body 11) when being stored or taken out, and thus it is possible to surely prevent deformation, damage, or dirt on the roller main body 2.

In addition, since the inner diameter of the open grooves 27 is formed to be of a size that allows the operator's fingertip to be inserted, the operator, when storing or taking out the roller 1, can touch the front and rear end faces of the shaft end portions 4 with his/her fingertips of both hands from the axially outer side (insert the fingertips into the shaft-end-face holes 6) to support the rotation shaft 3 and can moves up and down the roller 1 (the rotation shaft 3). This improves the workability.

Next, a second embodiment of the present invention will be described with reference to FIGS. 7 to 9. The second embodiment is one having adapters (shaft attachment members) 47 attached to the rotation shaft 3. Hence the constituents common to those in the first embodiment will be denoted by the same reference signs, and description thereof will be omitted.

As illustrated in FIGS. 7 to 9, the adapter 47 integrally has an adapter base 48 in a cylindrical column shape or cylindrical tubular shape having approximately the same outer diameter as the shaft end portion 4, an adapter small-diameter portion 49 in a. cylindrical column shape or cylindrical tubular shape protruding from one end of the adapter base 48, and an adapter large-diameter portion 50 in a collar shape provided at the other end of the adapter base 48. The adapter small-diameter portion 49 has a smaller diameter than the adapter base 48, and the adapter large-diameter portion 50 has a diameter larger than that of the adapter base 48 and smaller than that of the roller main body 2. The outer diameter of the adapter small-diameter portion 49 is set approximately the same as or slightly smaller than the inner diameter of the shaft-end-face hole 6 of the shaft end portion 4, and the adapter 47 is detachably attached to the end face of the shaft end portion 4 by inserting the adapter small-diameter portion 49 into the shaft-end-face hole 6. The end face of the adapter 47 (adapter large-diameter portion 50) has an adapter end-face hole 51.

The first shaft-facing groove 25 of the first case body 11 and the second shaft-facing groove 42 of the second case body 12 each have a shallow groove 52 formed to fit the outer diameter of the adapter base 48 and a deep groove 53 formed to fit the outer diameter of the adapter large-diameter portion 50. A groove boundary 28 is formed in a step shape between the deep groove 53 and open groove 27 of the first shaft-facing groove 25, and the outer diameter of the adapter large-diameter portion 50 is larger than the inner diameter of the open groove 27.

When the adapter 47 is placed in the first shaft-facing groove 25, the adapter base 48 is inserted into the shallow groove 52, and the adapter large-diameter portion 50 is inserted into the deep groove 53. In the case-closed state, the adapter base 48 is clamped and held between the upper and lower shallow grooves 52, and/or the adapter large-diameter portion 50 is clamped and held between the upper and lower deep grooves 53. As described above, the outer peripheral surface of the adapter 47 has a protrusion-and-recess shape, and the first shaft-facing groove 25 and the second shaft-facing groove 42 each have a protrusion-and-recess shape that is engaged with the protrusion-and-recess shape of the adapter 47 to restrict the movement of the adapter 47. Note that only one of the first shaft-facing groove 25 and the second shaft-facing groove may have a protrusion-and-recess shape that is engaged with the protrusion-and-recess shape of the adapter 47 to restrict the movement of the adapter 47.

The present embodiment makes it possible to surely support the front and rear ends of the rotation shaft 3 via the adapter 47 in the case where the shaft end portions 4 of the rotation shaft 3 do not protrude long enough from the end faces of the roller main body 2.

In addition, as in the first embodiment, since the inner diameter of the open grooves 27 is formed to be of a size that allows the operator's fingertip to be inserted, the operator, when storing or taking out the roller 1, can touch the front and rear end faces of the adapter 47 with his/her fingertips of both hands from the axially outer side (insert the fingertips into the adapter end-face holes 51) to support the rotation shaft 3 and can moves up and down the roller 1 (the rotation shaft 3). This improves the workability.

In addition, since the engagement between the adapter 47 and the first and second shaft-facing grooves 25 and 42 restricts the movement of the adapter 47, the adapter 47 is prevented from falling from the first shaft-facing groove 25 in the case where an unintended external force acts on the roller case 10 in the roller-stored state and where the roller case 10 is deformed such that the first shaft-facing groove 25 moves in the axially outward direction. Thus, in the case where the roller 1 stored in the roller case 10 is transported and in like cases, it is possible to surely prevent deformation, damage, or dirt on the roller main body 2 resulting from contact with the roller case 10.

Note that the protrusion-and-recess shape for blocking the movement of the adapter 47 may be omitted. Hence one or both of the adapters 47 at the front and rear ends of the rotation shaft 3 may be an adapter without a protrusion-and-recess shape as above.

Alternatively, the adapter 47 may be attached to only one of the front and rear ends of the rotation shaft 3, and for the other end, the shaft end portion 4 may be directly supported by the first shaft-facing groove 25 and the second shaft-facing groove 42.

Alternatively, in the first embodiment, as in the second embodiment, the shaft end portion 4 may have a protrusion-and-recess shape while the first shaft-facing groove 25 and/or the second shaft-facing groove 42 have a protrusion-and-recess shape that is engaged with the protrusion-and-recess shape of the shaft end portion 4 to restrict the movement of the shaft end portion 4.

Next, a third embodiment of the present invention will be described with reference to FIGS. 10 to 12. The third embodiment is one having flanges (shaft-drop restricting members) 54 attached at the front and rear ends of the rotation shaft 3 in the first embodiment. Hence the constituents common to those in the first embodiment will be denoted by the same reference signs, and description thereof will be omitted.

As illustrated in FIGS. 10 to 12, the flange 54 has a hole-formed disk shape with an outer diameter larger than that of the roller main body 2. The flange 54 has, in its center, a shaft-passing hole 55 the inner diameter of which is approximately the same as or slightly larger than the outer diameter of the shaft end portion 4. Thus, the flange 54 can be detachably attached to the shaft end portion 4 at each of the front and rear ends by inserting the shaft end portion 4 into the shaft-passing hole 55. The entire area of the outer peripheral edge of the flange 54 attached to the shaft end portion 4 protrudes outward in the radial direction of the roller main body 2 beyond the outer peripheral surface of the roller main body 2. The insertion limit of flange 54 in the axially inward direction is defined by the step 5 of the shaft end portion 4, and this keeps the flange 54 and the roller main body 2 in no contact with each other.

The first cover portion 14 of the first case body 11 has a first flange-engagement groove (shaft-drop-restricting-member engagement groove) 56 that is engaged with the lower area of the outer peripheral edge of the flange 54 to restrict the movement of the flange 54 in the axis direction, and the second cover portion 31 of the second case body 12 has a second flange-engagement groove (shaft-drop-restricting-member engagement groove) 57 that is engaged with the lower area of the outer peripheral edge of the flange 54 to restrict the movement of the flange 54 in the axis direction. In the roller-stored state, the flanges 54 are positioned, within the roller-main-body containing space 46, both sides in the axis direction of the center portion where the roller main body 2 is positioned, and the outer peripheral edge of the flange 54 is engaged with the first flange-engagement groove 56 and the second flange-engagement groove 57. The outer peripheral surface of the flange 54 comes close to or into contact with the groove bottom of the first flange-engagement groove 56 and the groove bottom of the second flange-engagement groove 57.

Note that in an ordinary condition where no external force is acting on the roller case 10, the front and rear ends of the rotation shaft 3 are supported by the first shaft-facing grooves 25 and the second shaft-facing grooves 42, and the rotation shaft 3 is not supported by the flanges 54. However, the present invention does not exclude the flanges 54 supporting the rotation shaft 3. The rotation shaft 3 may be supported both by the first shaft-facing grooves 25 and second shaft-facing grooves 42 and by the flanges 54. In this case, the first shaft-facing groove 25 and the first flange-engagement groove 56 compose the first support portion, and the second shaft-facing groove 42 and the second flange-engagement groove 57 compose the second support portion.

The present embodiment enables the flange 54 to block the roller 1 from going down relative to the roller case 10 in the case where an unintended external force acts on the roller case 10 in the roller-stored state, where the roller case 10 is deformed such that the first shaft-facing groove 25 moves in the axially outward direction, and where a shaft end portion 4 is detached from the first shaft-facing groove 25. Hence, in the case where the roller 1 stored in the roller case 10 is transported and in like cases, it is possible to surely prevent deformation, damage, or dirt on the roller main body 2 resulting from contact with the roller case 10.

Note that the flange 54 may be attached to only one of the front and rear ends of the rotation shaft 3 instead of both of them. In the case where the positions of the steps 5 of the shaft end portions 4 and those of the end faces of the roller main body 2 are approximately the same in the axis direction, it is possible to keep the flange 54 and the roller main body 2 in no contact with each other by providing, on the axially inner side of the flange 54, a cylindrical protrusion 58 that comes into contact with the step 5, for example, as illustrated in FIG. 13. As an alternative, a flange may be integrally formed on an adapter (for example, an adapter 47 as in the second embodiment) configured to be detachably attached to the rotation shaft 3, and clamped and held between the first support portion the second support portion. The shape of the flange 54 is not limited to a disk shape but may be any shape as long as approximately the entire area of the outer peripheral edge of the flange protrudes radially outward beyond the outer peripheral surface of the roller main body 2 in the state where the flange 54 is attached to the rotation shaft 3.

Next, a fourth embodiment of the present invention will be described with reference to FIG. 14. The fourth embodiment is one having a hinge 59 via which the first case body 11 and second case body 12 in the first embodiment are connected. Hence, the constituents common to those in the first embodiment will be denoted by the same reference signs, and description thereof will be omitted.

As illustrated in FIG. 14, in a roller case 60 of the present embodiment, a second outer long-face portion 40 of the second case body 12 on one side (the right side in the figure) is connected to a first outer long-face portion 23 of the first case body 11 on one side (the left side in the figure) via the hinge 59 such that it can be opened and closed. Since the first case body 11 and the second case body 12 are connected via the hinge 59 as above, the roller case 60 can be opened and closed relatively easily.

Next, a fifth embodiment of the present invention will be described with reference to FIGS. 15 to 20. A roller case 100 of the fifth embodiment includes two case bodies 70 having the same shape that are used as the first case body 11 and the second case body 12, and front and rear flanges (a front flange 71 and a rear flange 72) that support the front and rear ends of the rotation shaft 3. Hence, the constituents common to those in the first embodiment will be denoted by the same reference signs, and description thereof will be omitted.

As illustrated in FIG. 17, the flanges (the front flange 71 and the rear flange 72) are detachably attached as shaft attachment members to the shaft end portions 4 at the front and rear ends of the rotation shaft 3. The front flange 71 and the rear flange 72 each have a disk shape with an outer diameter larger than that of the roller main body 2. As illustrated in FIGS. 15 and 19, the front flange 71 has, in its center, a shaft-passing hole 73 with an inner diameter approximately the same as or slightly larger than the outer diameter of the shaft end portion 4. The front flange 71 is detachably attached to the shaft end portion 4 at the front by inserting the shaft end portion 4 into the shaft-passing hole 73. As illustrated in FIGS. 15 and 20, the rear flange 72 integrally has, instead of the shaft-passing hole 73, a bottomed cylindrical portion 74 with an inner diameter approximately the same as or slightly larger than the outer diameter of the shaft end portion 4. The rear flange 72 can be detachably attached to the shaft end portion 4 at the rear end by inserting the shaft end portion 4 into the inner diameter portion of the bottomed cylindrical portion 74. The bottomed cylindrical portion 74 of the present embodiment has a shaft insertion portion 75 integrally formed in a cylindrical rod shape which is inserted into the shaft-end-face hole 6 of the shaft end portion 4 when the shaft end portion 4 is inserted into the inner diameter portion of the bottomed cylindrical portion 74. In the state where the flanges 71 and 72 are attached to the shaft end portions 4, the entire area of the outer peripheral edge of each of the flanges 71 and 72 protrudes outward in the radial direction of the roller main body 2 beyond the outer peripheral surface of the roller main body 2. Note that the front flange 71 may have a shape like the rear flange 72, and the rear flange 72 may have a shape like the front flange 71. Alternatively, only one of the front flange 71 and the rear flange 72 may be used while the shaft end portion 4 on the other side is supported by the case bodies 70 directly or via an adapter.

As illustrated in FIGS. 15 to 20, the case body 70 integrally has a base-face portion 76 in a rectangular frame shape (a picture frame shape) and a cover portion 77 recessed from the inner peripheral edge of the base-face portion 76 in one direction of the axis crossing direction. The cover portion 77 of the first case body 11 composes the first cover portion 14, and the cover portion 77 of the second case body 12 composes the second cover portion 31. The cover portion 77 forms a containing space 78 (a first containing space 26, a second containing space 43) that is open on the other side in the axis crossing direction. The case body 70 is approximately symmetrical relative to the axis direction so that it functions as both the first case body 11 and the second case body 12. In use, one (the first case body 11) of the two case bodies 70 (the first case body 11 and the second case body 12) is placed in the orientation in which the first containing space 26 is open upward (basic orientation), and the other (the second case body 12) is placed on top of the first case body 11 from above in the orientation (reverse orientation) in which it is reversed from the basic orientation (rotated by 180 degrees about the axis direction) so that the second containing space 43 is open downward.

The base-face portion 76 has a pair of right and left base-long-face portions 79 which are the long sides of the rectangular frame and a pair of front and rear base-short-face portions 80 which are the short sides of the rectangular frame. The base-long-face portions 79 extend in the front-rear direction along the axis direction, and the base-short-face portions 80 extend in the right-left direction along an axis crossing direction.

The cover portion 77 has a center cover portion 81 formed in a wide range in the center of the axis direction and a pair of front and rear end cover portions 82 formed at both sides in the axis direction of the center cover portion 81 and continuing to the center cover portion 81. The center cover portion 81 has a pair of right and left cover side-face portions 83, a pair of front and rear cover connecting-face portions 84, and a cover top-face portion 85. The front and rear end cover portions 82 each have a circular-arc face portion 86 and a cover end-face portion 87. The cover side-face portion 83 has a rectangular shape extending downward from the inner edge of the center portion in the axis direction of the base-long-face portion 79. The cover top-face portion 85 has a rectangular shape connecting the end edges of the right and left cover side-face portions 83. The circular-arc face portion 86 has a circular arc shape connecting the inner edges of both end portions of the base-long-face portions 79. The cover end-face portion 87 has a semicircular disk shape extending downward from the inner edge of the base-short-face portion 80. The cover connecting-face portion 84 connects the end edges on the axially outer side of the cover side-face portions 83 and the cover top-face portion 85 and the end edge on the axially inner side of the circular-arc face portion 86 so as to close the area between the end edges of the cover side-face portions 83 and the cover top-face portion 85 and the end edge of the circular-arc face portion 86.

A flange-engagement groove recessed from the inner face of the circular-arc face portion 86 (a front flange-engagement groove 88 and a rear flange-engagement groove 89) is formed between the cover end-face portion 87 and the end edge on the axially outer side of the circular-arc face portion 86. The front flange-engagement groove 88 and rear flange-engagement groove 89 of the first case body 11 compose the first support portion, and the front flange-engagement groove 88 and rear flange-engagement groove 89 of the second case body 12 compose the second support portion. The cover top-face portion 85 serves as the cover bottom-face portion when the case body 70 is in the basic orientation and serves as the cover top-face portion when the case body 70 is in the reverse orientation.

The front and rear base-short-face portions 80 each have a shaft-facing move 90 having a groove shape recessed in an arc shape. The inner diameter of the front shaft-facing groove 90 is set a slightly larger than the outer diameter of the shaft end portion 4 of the rotation shaft 3, and the inner face of the front shaft-facing groove 90 faces the outer face of the front shaft end portion 4 of the rotation shaft 3, being close to or in contact with it. The inner diameter of the rear shaft-facing groove 90 is set slightly larger than the outer diameter of the bottomed cylindrical portion 74 of the rear flange 72, and the inner face of the rear shaft-facing groove 90 faces the outer face of the bottomed cylindrical portion 74, being close to or in contact with it.

The front flange-engagement groove 88 is engaged with approximately half of the outer peripheral edge of the front flange 71 to support the front flange 71 from the radially outer side and restricts the movement in the axis direction of the front flange 71. The rear flange-engagement groove 89 is engaged with approximately half of the outer peripheral edge of the rear flange 72 to support the rear flange 72 from the radially outer side and restricts the movement in the axis direction of the rear flange 72. The front and rear cover end-face portions 87 each have end-face protrusions 91 formed to protrude in the axially inward direction. The front flange 71 has front-flange recesses 66 that are engaged with the front end-face protrusions 91 in the state where the front flange 71 is engaged with the front flange-engagement groove 88. The engagement between the front-flange recesses 66 and the front end-face protrusions 91 defines the position of the front flange 71 within the from flange-engagement groove 88 and makes stable the support of the front flange 71 by the case body 70. Similarly, the rear flange 72 has rear-flange recesses 67 that are engaged with the rear end-face protrusions 91 in the state where the rear flange 72 is engaged with the rear flange-engagement groove 89. The engagement between the rear-flange recesses 67 and the rear end-face protrusions 91 defines the position of the rear flange 72 within the rear flange-engagement groove 89 and makes stable the support of the rear flange 72 by the case body 70.

Note that in an ordinary condition where no external force is acting on the roller case 100, the front and rear ends of the rotation shaft 3 are supported by the front flange 71 and the rear flange 72, and the rotation shaft 3 is not supported by the shaft-facing groove 90. However, the present invention does not exclude the shaft-facing grooves 90 supporting the rotation shaft 3. The rotation shaft 3 may be supported by both the shaft-facing grooves 90 and the flanges 71 and 72. In this case, the shaft-facing grooves 90, front flange-engagement groove 88, and rear flange-engagement groove 89 of the first case body 11 compose the first support portion, and the shaft-facing grooves 90, front flange-engagement groove 88, and rear flange-engagement groove 89 of the second case body 12 compose the second support portion.

The shapes of the flanges 71 and 72 are not limited to disk shapes. The flanges 71 and 72 may have any shapes as long as approximately the entire area or multiple areas of the outer peripheral edge the flange protrudes outward in the radial direction of the roller main body 2 beyond the outer peripheral surface of the roller main body 2 in the state where the flange is attached to the rotation shaft 3. In the case where multiple areas of the outer peripheral edge of the flange protrude radially outward beyond the outer peripheral surface of the roller main body 2, the flange can be held by the multiple areas being clamped between the first case body 11 and the second case body 12. For example, in the case of a flange 101 in a triangular plate shape in which the center portions of the three edges are positioned radially inward of the outer peripheral surface of the roller main body 2, and in which three vertex portions 102 protrude radially outward beyond the outer peripheral surface of the roller main body 2, as illustrated in FIG. 21, the flange 101 can be held by the three vertex portions 102 being clamped between the first case body 11 and the second case body 12, for example, in such a way that two vertex portions 102 are engaged with the flange-engagement groove of the first case body 11, and that one vertex portion 102 is engaged with the flange-engagement groove of the second case body 12.

The front base-short-face portion 80 has a front locking protrusion 93 and a front engagement recess 94, and the rear base-short-face portion 80 has a rear locking protrusion 95 and a rear engagement recess 96. The front and rear locking protrusions 93 and 95 protrude from the base-short-face portions 80 on the other side in the axis crossing direction, and the front and rear engagement recesses 94 and 96 are recessed from the base-short-face portions 80 on the one side in the axis crossing direction so as to be able to be engaged with the front and rear locking protrusions 93 and 95. The front locking protrusion 93 and engagement recess 94 are arranged to be symmetric relative to the axis direction, and the rear locking protrusion 95 and engagement recess 96 are arranged in the same way so that a case body 70 in the basic orientation can be engaged with a case body 70 in the reverse orientation.

The right and left base-long-face portions 79 each have a positioning protrusion 97 and a positioning recess 98. The right and left positioning protrusions 97 protrude on the other side in the axis crossing direction from the base-long-face portions 79, and the right and left positioning recesses 98 are recessed on the one side in the axis crossing direction from the base-long-face portions 79 such that the right and left positioning protrusions 97 can be inserted into the right and left positioning recesses 98. The left positioning protrusion 97 are the right positioning recess 98 are arranged to be symmetric relative to the axis direction, and the left positioning recess 98 and the right positioning protrusion 97 are arrange in the same way so that a case body 70 in the basic orientation can be engaged with a case body 70 in the reverse orientation.

One case body 70 (a first case body 11) is placed in the basic orientation in which the containing space 78 is open upward. The other case body 70 (a second case body 12) in the reverse orientation in which the containing space 78 is open downward is placed on top of the one case body 70 from above and pushed down such that the positioning protrusions 97 are inserted into the positioning recesses 98. The locking protrusions 93 and 95 of the second case body 12 are engaged with the engagement recesses 94 and 96 of the first case body 11, and the case bodies 70 are put into the case-closed state. The case-closed state is kept by the engagement between the locking protrusions 93 and 95 and the engagement recesses 94 and 96. In the case-closed state, the base-face portion 76 of the first case body 11 and the base-face portion 76 of the second case body 12 faces each other being close to or in contact with each other, and the first containing space 26 and the second containing space 43 form the roller-main-body containing space 46.

In the case-open state where the engagement of the locking protrusions 93 and 95 and the engagement recesses 94 and 96 is released, the first case body 11 and the second case body 12 are separated, and the roller-main-body containing space 46 is open, the front flange 71 and the rear flange 72 are placed from above and engaged with the front flange-engagement groove 88 and rear flange-engagement groove 89 of the first case body 11 in the basic orientation. Then, by placing the second case body 12 on top of the first case body 11 to put the case bodies 70 into the case-closed state, the roller case is put into the roller-stored state where the roller 1 is stored in the roller case 100. In the roller-stored state, the roller main body 2 is contained in the roller-main-body containing space 46, being spaced from the first case body 11 and the second case body 12. The front flange 71 and the rear flange 72 are clamped and held in the axis crossing direction between the front and rear flange-engagement grooves 88 and 89 of the first case body 11 and the front and rear flange-engagement grooves 88 and 89 of the second case body 12. The entire roller 1 is covered by the first case body 11 and the second case body 12. The movement of the rotation shaft 3 in the axis direction and in the axis crossing direction is blocked by the front flange 71 and the rear flange 72.

Meanwhile, the cover top-face portion 85 has multiple furrow-shaped ribs 68 and ring-shaped ribs 69 protruding outward to reinforce the cover top-face portion 85. In the present embodiment, two furrow-shaped ribs 68 and two ring-shaped ribs 69 are arranged diagonally. When the outer face of the cover top-face portion 85 of one case body 70 is placed on top of the outer face of the cover top-face portion 85 of the other case body 70 with these outer faces facing each other, the furrow-shaped ribs 68 are inserted into and engaged with the inner spaces of the ring-shaped ribs 69. The engagement as above makes stable the stacking state of the first case body 11 and the second case body 12, making it possible to stack multiple roller cases 100 in the roller-stored state.

When the roller 1 is stored into the roller case 100, the front flange 71 and the rear flange 72 are attached to the rotation shaft 3. The roller case 100 is put into the case-open state. The first case body 11 is placed in the standard orientation in which the first containing space 26 is open upward. The roller 1 is moved from above down to the first case body 11. The front flange 71 and the rear flange 72 are engaged with and placed in the front and rear flange-engagement grooves 88 and 89 of the first case body 11 from above. In this rotation-shaft-placed state, the lower part of the roller main body 2 is housed in the first containing space 26, and the lower area of the outer peripheral surface of the roller main body 2 is covered with the first cover portion 14 without being in contact with it. Next, the second case body 12 in the reverse orientation is put on the first case body 11 from above such that the positioning protrusions 97 are inserted into the positioning recesses 98, and thereby the locking protrusions 93 and 95 are engaged with the engagement recesses 94 and 96. In this roller-stored state (the case-closed state in which the roller 1 is stored), the upper part of the roller main body 2 is housed in the second containing space 43, the upper area of the outer peripheral surface of the roller main body 2 is covered with the second cover portion 31 without being in contact with it, and the roller main body 2 is contained in the roller-main-body containing space 46. Also in the roller-stored state, the front flange 71 and the rear flange 72 are clamped and held in the axis crossing direction between the front and rear flange-engagement grooves 88 and 89 of the first case body 11 and the front and rear flange-engagement grooves 88 and 89 of the second case body 12, and the entire roller 1 is covered with the first case body 11 and the second case body 12.

When the roller 1 is taken out of the roller case 100, the second case body 12 is lifted up to be separated from the first case body 11, and the engagement between the engagement recesses 94 and 96 of the first case body 11 and the locking protrusions 93 and 95 of the second case body 12 is released to put the roller case 100 into the case-open state. The front flange 71 and the rear flange 72 are pinched with both hands and to pull up the roller 1 (the rotation shaft 3), and the roller 1 is taken out of the first case body 11.

When the roller 1 is stored into the roller case 100 or a stored roller 1 is taken out of the roller case 100 as above, storing or taking-out work can be performed easily because the roller 1 is moved not in the axis direction (the front-rear direction) but in the axis crossing direction (the up-down direction). In addition, since the roller main body 2 does not touch the roller case 100 (first case body 11) easily when being stored or taken out, it is possible to surely prevent deformation, damage, or dirt on the roller main body 2.

In addition, since the operator, when storing or taking out the roller 1, can move up and down the roller 1 (the rotation shaft 3), pinching the front flange 71 and the rear flange 72 with his/her both hands, the workability is improved.

In addition, since the front flange 71 and the rear flange 72 in a disk shape having a diameter larger than the roller main body 2 are clamped between the first case body 11 (the front and rear flange-engagement grooves 88 and 89 of the first case body 11) and the second case body 12 (the front and rear flange-engagement grooves 88 and 89 of the second case body 12), and thereby the front and rear ends of the rotation shaft 3 is held, holding of the front and rear ends of the rotation shaft 3 is not less likely to be released in the case where an unintended external force acts on the roller case 100 in the roller-stored state. Hence, in the case where the roller 1 is stored into the roller case 100 and transported or the like cases, it is possible to surely prevent deformation, damage, or dirt on the roller main body 2 resulting from contact with the roller case 100.

In addition, even in the case where the shaft end portions 4 of the rotation shaft 3 do not protrude long enough from the end faces of the roller main body 2, it possible to surely support the front and rear ends of the rotation shaft 3 via the front flange 71 and the rear flange 72.

Next, a sixth embodiment of the present invention will be described with reference to FIGS. 22 to 24. The sixth embodiment is one configured such that each flange (the front flange 71 and the rear flange 72) in the fifth embodiment is composed of a combination of multiple (two, in the present embodiment) divided flanges (divided plates) 103 and 104. Hence, the constituents common to those in the fifth embodiment will be denoted by the same reference signs, and description thereof will be omitted.

The front flange 71 is composed of a combination of two divided flanges 103 that can be separated and detached from the rotation shaft 3 in an axis crossing direction as illustrated in FIG. 22, and the shaft-passing hole 73 is also divided into two. Similarly, the rear flange 72 is composed of a combination of two divided flanges 104 that can be separated and detached from the rotation shaft 3 in an axis crossing direction as illustrated in FIG. 23. The rear flange 72 has a tubular portion 99 instead of the bottomed cylindrical portion 74, and the tubular portion 99 is also divided into two. The two divided flanges 103 each have approximately the same size and shape, and the division plane (combination plane) is set along a diameter direction of the front flange 71. Similarly, the two divided flanges 104 each have approximately the same size and shape, and the division plane (combination plane) is set along a diameter direction of the rear flange 72. Note that each flange (the front flange 71 and the rear flange 72) may be divided into three or more divided plates.

The attachment state where the flanges 71 and 72 are attached to the rotation shaft 3 (the state where the two divided flanges 103 and 104 are combined) are kept by engaging the flanges 71 and 72 with the flange-engagement grooves 88 and 89 of the first case body 11 and the second case body 12 and closing the first case body 11 and the second case body 12 to put them into the roller-stored state.

The two divided flanges 103 composing the front flange 71 are attached to the rotation shaft 3 in the orientation where each of the divided flanges 103 is engaged with both the front flange-engagement groove 88 of the first case body 11 and the front flange-engagement groove 88 of the second case body 12, and the two divided flanges 104 composing the rear flange 72 are attached to the rotation shaft 3 in the orientation where each of the divided flanges 104 is engaged with both the rear flange-engagement groove 89 of the first case body 11 and the rear flange-engagement groove 89 of the second case body 12. In other words, the detachment direction of the divided flanges 103 and 104 from the rotation shaft 3 is set to be different from the separation direction of the first case body 11 and the second case body 12. In the present embodiment, the separation direction of the first case body 11 and the second case body 12 and the detachment direction of the divided flanges 103 and 104 from the rotation shaft 3 are set to be approximately orthogonal to each other. Approximately half the area of each of the two divided flanges 103 is engaged with each of the upper and lower flange-engagement grooves 88 of the case body 70, and approximately half the area of each of the two divided flanges 104 is engaged with each of the upper and lower flange-engagement grooves 89 at the rear of the case body 70.

When the roller 1 is stored in the roller case 100, the roller case 100 is put into the case-open state. The first case body 11 is placed in the standard orientation in which the first containing space 26 is open upward. The roller 1 is moved from above down to the first case body 11 with the front and rear flanges 71 and 72 assembled to the rotation shaft 3 (with both the two divided flanges 103 and 104 assembled at the front and rear of the rotation shaft 3). Each of the front and rear flanges 71 and 72 is inserted into and engaged with the front and rear flange-engagement grooves 88 and 89 of the first case body 11 from above. In this rotation-shaft-placed state, the lower part of the roller main body 2 is housed in the first containing space 26, and the lower areas of the outer peripheral surface and both end faces of the roller main body 2 are covered with the first cover portion 14 without being in contact with it. FIG. 24 is a rear view of the first case body in the rotation-shaft-placed state. Note that the subsequent procedures are the same as those in the fifth embodiment.

When the roller case 100 is taken out of the roller 1, the roller case 100 is put into the case-open state as in the fifth embodiment. Then, the roller 1 is pulled up with the front and rear shaft end portions 4 of the rotation shaft 3 supported with fingertips of both hands. Then, the roller 1 is taken out of the first case body 11, and the front and rear divided flanges 103 and 104 are removed from the rotation shaft 3.

In the present embodiment, the front and rear flanges 71 and 72 can be attached to the rotation shaft 3 by assembling the front divided flanges 103 and the rear divided flanges 104 to the rotation shaft 3 in an axis crossing direction, and the flanges 71 and 72 can be removed from the rotation shaft 3 by separating and detaching the front divided flanges 103 and the rear divided flanges 104 from the rotation shaft 3 in the axis crossing direction. Thus, the flanges 71 and 72 can be attached or detached more easily than flanges 71 and 72 of a non-separation type as in the fifth embodiment.

Note that the present invention is not limited to the foregoing embodiments and their examples which have been described exemplarily. Other than the foregoing embodiments and the like, various modifications can be made according to designs or the like without departing from the technical idea according to the present invention.

For example, the structure for attaching the shaft attachment member (adapter 47, front flange 71, rear flange 72, flange 101) to the rotation shaft 3 is not limited to the above embodiments. Other structures may be used (for example, a structure in which a male thread is formed on one of a shaft attachment member and the rotation shaft 3, and a female thread is formed on the other, and in which the shaft attachment member is attached to the rotation shaft 3 by the engagement between the male thread the female thread).

INDUSTRIAL APPLICABILITY

The present invention is useful as a roller case for storing a roller having a roller main body made of an elastic porous material and a rotation shaft that support the roller main body.

REFERENCE SIGNS LIST

1 roller
2 roller main body
3 rotation shaft
4 shaft end portion
5 step
6 shaft-end-face hole
10, 60, 100 roller case
11 first case body (lower case)
12 second case body (upper case)
13 first base-face portion
14 first cover portion
15 first outer-peripheral-face portion
16 first edge-face portion
17 first base-long-face portion
18 first base-short-face portion
19 first cover long-face portion
20 first cover short-face portion
21 cover bottom-face portion
22 first rib
23 first outer long-face portion
24 first outer short-face portion
25 first shaft-facing groove (first support portion)
26 first containing space
27 open groove
28 groove boundary
29, 94, 96 engagement recess
30 second base-face portion
31 second cover portion
32 second outer-peripheral-face portion
33 second edge-face portion
34 second base-long-face portion
35 second base-short-face portion
36 second cover long-face portion
37 second cover short-face portion
38 cover top-face portion
39 second rib
40 second outer long-face portion
41 second outer short-face portion
42 second shaft-facing groove (second support portion
43 second containing space
44 groove end
45, 93, 95 locking protrusion
46 roller-main-body containing space
47 adapter (shaft attachment member)
48 adapter base
49 adapter small-diameter portion
50 adapter large-diameter portion
51 adapter end-face hole
52 shallow groove
53 deep groove
54 flange (shaft-drop restricting member)
55, 73 shaft-passing hole
56 first flange-engagement groove (shaft-drop-restricting-member engagement groove)
57 second flange-engagement groove (shaft-drop-restricting-member engagement groove)
58 protrusion
59 hinge
66 front-flange recess
67 rear-flange recess
68 furrow-shaped rib
69 ring-shaped rib
70 case body
71 front flange (shaft attachment member)
72 rear flange (shaft attachment member)
74 bottomed cylindrical portion
75 shaft insertion portion
76 base-face portion
77 cover portion
78 containing space
79 base-long-face portion
80 base-short-face portion
81 center cover portion
82 end cover portion
83 cover side-face portion
84 cover connecting-face portion
85 cover top-face portion
86 circular-arc face portion

87 cover end-face portion
88 front flange-engagement groove (first support portion, second support portion)
89 rear flange-engagement groove (first support portion, second support portion)
90 shaft-facing groove
91 end-face protrusion
97 positioning protrusion
98 positioning recess
101 flange (shaft attachment member)
102 vertex portion
103, 104 divided flange (divided plate)

The invention claimed is:

1. A roller case for storing a roller having a cylindrical roller main body made of elastic porous material and a rotation shaft, an inner peripheral surface of the roller main body being supported by an outer peripheral surface of the rotation shaft, comprising:

the roller, a first case body including:

two first support portions that are on a first side of the first case body and a second side of the first case body, opposite of the first side of the first case body, respectively, the two first support portions capable of supporting a first end of the rotation shaft and a second end of the rotation shaft, opposite the first end, respectively, from one direction of an axis crossing direction intersecting an axis direction of the rotation shaft, and a first cover portion forming a first containing space that is open in another direction opposite the one direction in the axis crossing direction between the first support portion on the first side of the first case body and the first support portion on the second side of the first case body; and a second case body including:

two second support portions that are on a first side of the second case body and a second side of the second case body, opposite of the first side of the second case body, respectively, the two first support portions capable of supporting the first end and the second end of the rotation shaft, respectively, from the other direction of the axis crossing direction, and a second cover portion forming a second containing space that is open in the one direction in the axis crossing direction between the second support portion on the first side of the second case body and the second support portion on the second side of the second case body, the second case body being configured to be engaged with the first case body in a case-closed state where the first containing space and the second containing space form a roller-main-body containing space and being capable of keeping the case-closed state, wherein in a roller-stored state where the roller is stored, the case-closed state is kept by engagement between the first case body and the second case body, the roller main body is contained in the roller-main-body containing space, being spaced from the first case body and the second case body, the first end and the second end of the rotation shaft are clamped in the axis crossing direction and held between the two first support portions and the two second support portions, and the entire roller is covered with the first case body and the second case body, the roller includes, at at least the first end of the rotation shaft, a shaft attachment member that is detachably attached to the rotation shaft, the shaft attachment member clamped and held between the first support portion on the first side of the first case body and the second support portion on the first side of the second case body, and at least one first support portion from among the two first support portions of the first case body has a width, in the axis crossing direction, that is greater than a width of the cylindrical roller main body in the axis crossing direction, and is configured to hold the shaft attachment member along the width of the at least one first support portion.

2. The roller case according to claim 1, wherein approximately an entire area or multiple areas of an outer peripheral edge of the shaft attachment member attached to the rotation shaft protrude outward in radial directions of the roller main body beyond an outer peripheral surface of the roller main body, and an area of the shaft attachment member, protruding beyond the outer peripheral surface of the roller main body is clamped and held between the first support portion on the first side of the first case body and the second support portion on the first side of the second case body.

3. The roller case according to claim 2, wherein the shaft attachment member includes a combination of multiple divided plates detachable from the rotation shaft by being separated in the axis crossing direction.

4. The roller case according to claim 1, wherein a width of a portion of the shaft attachment member in the axis crossing direction is greater than the width of the cylindrical roller main body in the axis crossing direction, and an entirety of the portion of the shaft attachment member is held within the at least one first support portion.

5. The roller case according to claim 4, wherein the shaft attachment member includes a flange that includes the portion, and the at least one first support portion is a groove that is configured to hold the portion.

* * * * *